US009556841B2

(12) United States Patent
Tagawa et al.

(10) Patent No.: US 9,556,841 B2
(45) Date of Patent: Jan. 31, 2017

(54) FUEL SUPPLY SYSTEM FOR INTERNAL COMBUSTION ENGINE

(71) Applicant: AISAN KOGYO KABUSHIKI KAISHA, Obu-shi, Aichi-ken (JP)

(72) Inventors: Naoyuki Tagawa, Nagoya (JP); Minoru Akita, Ama (JP)

(73) Assignee: AISAN KOGYO KABUSHIKI KAISHA, Obu-shi, Aichi-ken (JP)

( * ) Notice: Subject to any disclaimer, the term of this patent is extended or adjusted under 35 U.S.C. 154(b) by 0 days.

(21) Appl. No.: 14/712,337

(22) Filed: May 14, 2015

(65) Prior Publication Data

US 2015/0330346 A1 Nov. 19, 2015

(30) Foreign Application Priority Data

May 15, 2014 (JP) ..... 2014-101100

(51) Int. Cl.
*F02M 59/00* (2006.01)
*F02M 59/20* (2006.01)
*F02M 37/08* (2006.01)

(52) U.S. Cl.
CPC ..... *F02M 59/20* (2013.01); *F02M 37/08* (2013.01)

(58) Field of Classification Search
CPC .. F02M 59/20; F02M 37/08; F02M 2037/082; F02M 2037/085
See application file for complete search history.

(56) References Cited

U.S. PATENT DOCUMENTS 5,284,119 A * 2/1994 Smitley ..... F02D 33/006 123/497
7,853,398 B2 * 12/2010 Hirowatari ..... F02D 41/3836 123/299
8,844,503 B2 * 9/2014 Worthington ..... F02M 37/22 123/446
2007/0186908 A1 * 8/2007 Fukasawa ..... F02D 41/08 123/458
2008/0202476 A1 * 8/2008 Teets ..... F02D 41/021 123/497
2012/0156056 A1 * 6/2012 Akita ..... F04B 49/065 417/42
2012/0156057 A1 * 6/2012 Akita ..... F02D 41/3082 417/44.2

FOREIGN PATENT DOCUMENTS

JP 2005-337167 A 12/2005

OTHER PUBLICATIONS

Korean Patent Application No. 10-2015-0057018 Notification of Reason for Refusal dated Aug. 26, 2016 (7 pages).

* cited by examiner

*Primary Examiner* — Hieu T Vo
*Assistant Examiner* — Sherman Manley
(74) *Attorney, Agent, or Firm* — Conley Rose, P.C.

(57) ABSTRACT

A fuel supply system may include a fuel pump configured to supply fuel from a fuel tank to a target, a motor for driving the fuel pump, and a controller coupled to the motor. The controller may determine a duty ratio of a control signal through a feedback control and to output the control signal to the motor, so that a fuel pressure of the fuel supplied from the fuel tank approaches a target fuel pressure. The controller may estimate the duty ratio based on the target fuel pressure and information regarding a fuel pressure of the fuel supplied from the fuel tank, and may guard an upper limit of the duty ratio by an upper limit guard value. The upper limit guard value may be determined based on a rotational speed of the motor.

11 Claims, 23 Drawing Sheets

FUEL SUPPLY SYSTEM FOR INTERNAL COMBUSTION ENGINE

CROSS-REFERENCE TO RELATED APPLICATIONS

This application claims priority to Japanese patent application serial number 2014-101100 filed May 15, 2014, the contents of which are incorporated herein by reference in their entirety for all purposes.

STATEMENT REGARDING FEDERALLY SPONSORED RESEARCH OR DEVELOPMENT

Not applicable.

BACKGROUND

Embodiments of the present disclosure relate to fuel supply systems used for internal combustion engines.

A known fuel supply system may include a fuel pump for pressure-feeding fuel stored in a fuel tank to an internal combustion engine, a motor for driving the fuel pump, and a controller for feedback-controlling the duty ratio of the voltage applied to the motor such that the fuel pressure approaches to a target fuel pressure.

In recent years, in fuel supply systems used for vehicles, pressurized fuel supplied from a fuel piping may be injected into the engine (internal combustion engine) by injectors. In addition, in order to further improve the fuel efficiency, etc., the pressure of the fuel discharged from the fuel pump is feedback-controlled to increase or decrease the pressure of the fuel in the fuel piping according to the engine operation condition, etc.

For example, Japanese Laid-Open Patent Publication No. 2008-14183 discloses an internal combustion engine control apparatus which performs a feedback control of a fuel pump only within a predetermined range and which, if the fuel pressure is deviated from a target fuel pressure, quickly restores it to the target fuel pressure. In this internal combustion engine control apparatus, when the fuel pressure is not higher than (i.e., less than or equal to) a lower limit value of the feedback control region, the fuel pump may be driven with a maximum capability (duty ratio=100%), and when the fuel pressure is not lower than (i.e., greater than or equal to) an upper limit value of the feedback control region, the fuel pump may be stopped (duty ratio=0%) to restore it quickly to the feedback control region.

Japanese Laid-Open Patent Publication No. 2013-108503 discloses a fuel pressure control apparatus, in which the fuel pump is controlled such that the operation amount of the fuel pump is calculated from a smoothed feedback operation amount and a feed-forward operation amount in order to improve the responsiveness and convergent property during a transient period.

In the case where the feedback control of the fuel pressure is performed, if, for example, the target fuel pressure abruptly increases, there is a possibility that the rotational speed of the motor driving the fuel pump exceeds an upper limit rotational speed of the motor. If the motor is driven at a rotational speed exceeding the upper limit rotational speed, there is a possibility that the motor is stepped out, and that wear amount of bearings, etc. increases, resulting in a short service life of the motor, which is not desirable.

There has been a need in the art for techniques of inhibiting stepping-out of the motor, and for decreasing the wear amount of the bearings, etc.

SUMMARY

In one aspect according to the present disclosure, a fuel supply system for an internal combustion engine may include a fuel pump, a motor and a controller. The fuel pump may pump fuel from within a fuel tank and discharge the pumped fuel to the internal combustion engine. The motor may drive the fuel pump. The controller may be coupled to the motor and may determine a duty ratio of a control signal through a feedback control and may output the control signal to the motor, so that a fuel pressure of the fuel discharged from the fuel pump approaches a target fuel pressure. The controller may estimate the duty ratio based on the target fuel pressure and information regarding the fuel pressure of the fuel discharged from the fuel pump. The controller may then guard an upper limit of the duty ratio by an upper limit guard value that may be changed based on a rotational speed of the motor. For example, the rotational speed of the motor may be estimated based on the control signal that is outputted to the motor.

Because the upper limit guard value may be changed based on the rotational speed of the motor, it may be possible to perform the feedback control such that the rotational speed does not exceed the upper limit rotational speed of the motor. As a result, it is possible to inhibit stepping-out of the motor, and to decrease the wear amount of motor bearings, etc.

Typically, the rotational speed of the motor may change with time according to a predetermined guard period, a first period, a second period and a third period. During the predetermined guard period, the rotational speed may increase from a value lower than a first rotational speed to reach a first rotational speed. The first rotational speed may be lower than a predetermined upper limit value of the motor and may reach the first rotational speed at a first time. During the first period after the first time, the rotational speed of the motor may exceed the first rotational speed. During the second period after the first period, the rotational speed of the motor may be less than the first rotational speed and may be not less than (i.e., greater than or equal to) a second rotational speed that is not less than (i.e., greater than or equal to) the first rotational speed. During the third period after the second period, the rotational speed of the motor may be less than the second rotational speed.

In one embodiment, controller may be further configured such that the upper limit guard value is set to a predetermined upper limit value of the motor during the predetermined guard period; the upper limit guard value at the first time is set to a current duty ratio that is currently applied; and the upper limit guard value gradually decreases during the first period.

By setting the upper limit guard value to the predetermined upper limit value during the predetermined guard period, it is possible to inhibit the duty ratio from exceeding the predetermined upper limit value at the first time. In addition, by gradually decreasing the upper limit guard value during the first period, it may be possible to appropriately perform a feedback control to inhibit the rotational speed from exceeding the upper rotational speed of the motor. In this respect, it is possible to further reliably inhibit stepping-out of the motor, and to decrease the wear amount of motor bearings, etc In this case, the controller may be further configured such that the upper limit guard value is maintained without being updated during the second period. In addition, if the target fuel pressure is not less than (i.e., greater than or equal to) an actual fuel pressure during the third period, the upper limit guard value may be maintained without being updated. On the other hand, if the target fuel pressure is less than the actual fuel pressure during the third period, the upper limit guard value may be set to the predetermined upper limit value.

In this way, during the second period and the third period, it is possible to return the upper limit guard value to the predetermined upper limit value at an appropriate time after the upper guard value has been reduced.

In another embodiment, the controller may be further configured such that the upper guard value is set to a predetermined upper limit value of the motor during the predetermined guard value; the upper guard value at the first time is set to a current duty ratio that is currently applied; and the upper limit guard is maintained without being updated during the first period.

By setting the upper guard value to the predetermined upper limit value during the predetermined guard period, it is possible to inhibit the duty ratio from exceeding the predetermined upper limit value at the first time. In addition, by maintaining the upper limit guard value without being updated during the first period, it may be possible to appropriately perform a feedback control to inhibit the rotational speed from exceeding the upper rotational speed of the motor. In this respect, it is also possible to further reliably inhibit stepping-out of the motor, and to decrease the wear amount of motor bearings, etc.

In this case, the controller may be further configured such that the upper guard value is maintained without being updated during the second period, and the upper guard value is set to the predetermined upper limit value during the third period.

In this way, during the second period and the third period, it is possible to return the upper guard value set to the current duty ratio at the first time to the predetermined upper limit value at an appropriate time.

In a further embodiment, the controller may be further configured such that the upper guard value is set to a predetermined upper limit value of the motor during a predetermined guard period, the upper guard value at the first time is set to a predetermined lowering value lower than the predetermined upper limit value; and the upper limit guard value gradually decreases during the first period.

By setting the upper guard value at the first time to the predetermined lowering value lower than the predetermined upper limit value, it may be possible to forcibly lower the upper limit of the duty ratio. In addition, by gradually decreasing the upper limit guard value during the first period, it may be possible to gradually decrease the duty ratio. Therefore, it may be possible to appropriately perform a feedback control to inhibit the rotational speed from exceeding the upper rotational speed of the motor. In this respect, it is also possible to further reliably inhibit stepping-out of the motor, and to decrease the wear amount of motor bearings, etc In this case, the controller may be further configured such that the upper guard value gradually decreases if the rotational speed of the motor is lowering during the second period, and the upper guard value is maintained without being updated if the rotational speed of the motor is not lowering during the second period. The rotational speed of the motor may be less than the second rotational speed during the third period.

In this way, during the second period and the third period, it is possible to return the reduced upper guard value to the predetermined upper limit value at an appropriate time.

In a further embodiment, the controller may be further configured such that the upper guard value is set to a predetermined upper limit value of the motor during a predetermined guard period, and the upper limit guard value gradually decreases at the first time and during the first period.

By gradually decreasing the upper limit guard value at the first time and during the first period, it may be possible to gradually decrease the duty ratio. Therefore, it may be possible to appropriately perform a feedback control to inhibit the rotational speed from exceeding the upper rotational speed of the motor. In this respect, it is also possible to further reliably inhibit stepping-out of the motor, and to decrease the wear amount of motor bearings, etc.

Also in this case, the controller may be further configured such that the upper guard value gradually decreases if the rotational speed of the motor is decreasing during the second period, and the upper guard value is maintained without being updated if the rotational speed of the motor is not decreasing during the second period. The rotational speed of the motor may be less than the second rotational speed during the third period.

In a further embodiment, the controller may be further configured to calculate a fuel pressure duty ratio and a rotational speed duty ratio and to select a smaller one of the fuel pressure duty ratio and the rotational speed duty ratio as the duty ratio of the control signal. The fuel pressure duty ratio may be determined based on a difference between the target fuel pressure and an actual fuel pressure. The rotational speed duty ratio may be determined based on a difference between a target rotational speed of the motor and an actual speed of the motor.

In this way, the smaller one of the fuel pressure duty ratio and the rotational speed duty ratio may be used as the duty ratio of the control signal. For example, if the motor rotational speed tends to exceed the upper limit, the controller may control the rotational speed duty ration such that it becomes smaller. In this respect, it is also possible to further reliably inhibit stepping-out of the motor, and to decrease the wear amount of motor bearings, etc.

DETAILED DESCRIPTION

Figure 1:
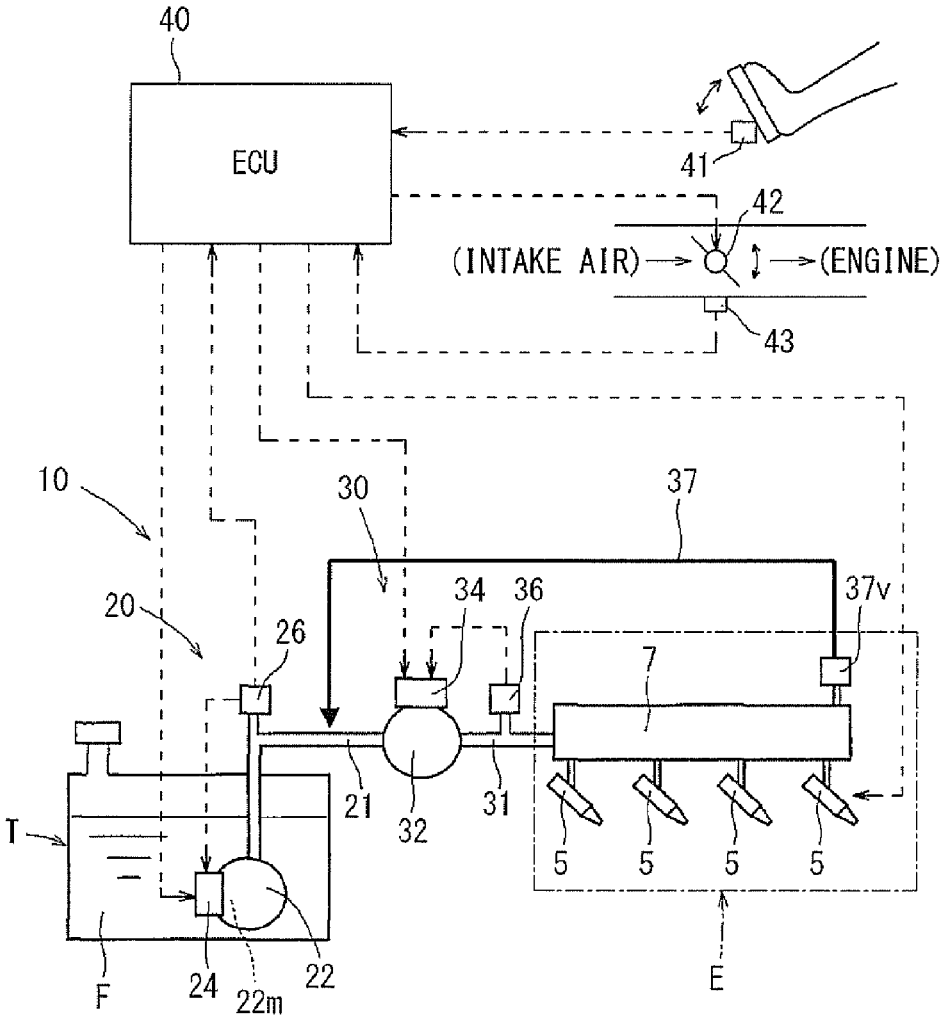
FIG. 1 is a diagram schematically illustrating a fuel supply system for an internal combustion engine and showing the construction of the fuel supply system, which is in common with first to fourth embodiments.

Referring to FIG. 1, there is shown a fuel supply system 10 that may be used for a vehicle engine system. The fuel supply system 10 may pump fuel F from within a fuel tank T and discharge the pumped fuel to an engine E that may be an internal combustion engine. The construction of the fuel supply system 10 shown in FIG. 1 is in common with the first to fourth embodiments that will be explained later.

As shown in FIG. 1, the fuel supply system 10 may include a low-pressure fuel pump unit 20 and a high-pressure fuel pump unit 30 that are connected in series with each other.

The low-pressure fuel pump unit 20 may pressure-feed the fuel F at a predetermined pressure to the high-pressure fuel pump unit 30 and may be connected to the high-pressure fuel pump unit 30 via low-pressure fuel piping 21. The low-pressure fuel pump unit 20 may include a fuel pump 22 disposed within the fuel tank T, a motor 22*m* for driving the fuel pump 22, a low-pressure controller 24 controlling the motor 22*m* based on a control signal outputted from an engine control unit 40 (hereinafter referred to as the ECU 40), and a pressure sensor 26 attached to the low-pressure fuel piping 21 for detecting a pressure P of the fuel F discharged from the fuel pump 22.

The low-pressure controller 24 may feedback-control the duty ratio of the voltage applied to the motor 22*m* such that the pressure P of the fuel F discharged from the fuel pump 22 (hereinafter referred to as the fuel pressure P) approaches to a target fuel pressure Ps set by the ECU 40. Further, the low-pressure controller 24 can appropriately increase and decrease an upper limit guard value, which is an upper limit value of the duty ratio, based on the rotational speed, etc. of the motor 22*m* such that the rotational speed of the motor 22*m* does not exceed the upper limit rotational speed of the motor 22*m* and that the fuel pressure P approaches to the target fuel pressure Ps. The increasing/decreasing process for the upper limit guard value will be described later.

The low-pressure controller 24 may estimate the rotational speed of the motor 22*m* based on a control signal that is outputted to the motor 22*m* from the low-pressure controller 24. For example, the control signal outputted to the motor 22*m* may be a PWM signal, the cycle and the duty ratio of which are variable. The low-pressure controller 24 may estimate the rotational speed of the motor 22*m* based on the cycle and the duty ratio of the PWM signal that is outputted from the low-pressure controller 24. Of course, it may be also possible to provide a motor rotational speed detection device capable of detecting the rotational speed of the motor 22*m*, so that the rotational speed of the motor 22*m* may be obtained by the detection signal from the motor rotational speed detection device. In this way, the low-pressure controller 24 can estimate or detect the rotational speed of the motor 22*m*.

A detection signal of an accelerator sensor 41 that detects the degree of opening of the accelerator pedal operated by the user may be inputted to the ECU 40. The ECU 40 may output a corresponding control signal to a throttle valve drive motor 42 that controls the flow of intake air supplied to the engine E. A detection signal of a throttle sensor 43 for detecting the degree of opening of a throttle valve may be inputted to the ECU 40. The ECU 40 may also receive detection signals from other detection devices (not shown) that may detect information on the operation condition of the engine. The other detection devices may include, for example, a flow rate sensor for intake air, a coolant temperature sensor, a crank rotation sensor, and a cylinder discrimination sensor. The ECU 40 may determine the target fuel pressure based on the detected operation condition of the engine, and may output the determined target fuel pressure to the low-pressure controller 24.

The high-pressure fuel pump unit 30 may increase the pressure P of the fuel F supplied from the low-pressure pump unit 20 and may supply the pressure-increased fuel to the engine E. The high-pressure fuel pump unit 30 may be connected to a delivery pipe 7 of the engine E via high-pressure fuel piping 31. The high-pressure fuel pump unit 30 may include a fuel pump 32, a high-pressure controller 34 controlling the fuel pump 32 based on a control signal from the ECU 40, and a pressure sensor 36 attached to the high-pressure fuel piping 31 for detecting the pressure of the fuel discharged from the fuel pump 32. The high-pressure fuel supplied to the delivery pipe 7 of the engine E by the high-pressure fuel pump unit 30 may be injected into combustion chambers (not shown) of the engine E from a plurality of injectors 5 attached to the delivery pipe 7. Here, surplus fuel in the delivery pipe 7 may be returned to the low-pressure fuel piping 21 via a valve 37*v* and return piping 37.

A control block diagram (FIG. 2) and a flowchart illustrating the process (FIG. 3) in a motor control of a low-pressure pump unit performed by a low-pressure controller according to a comparative example will now be described with reference to FIGS. 2 and 3. The process shown in FIG. 3 may be started at, for example, predetermined time intervals.

Figure 2:
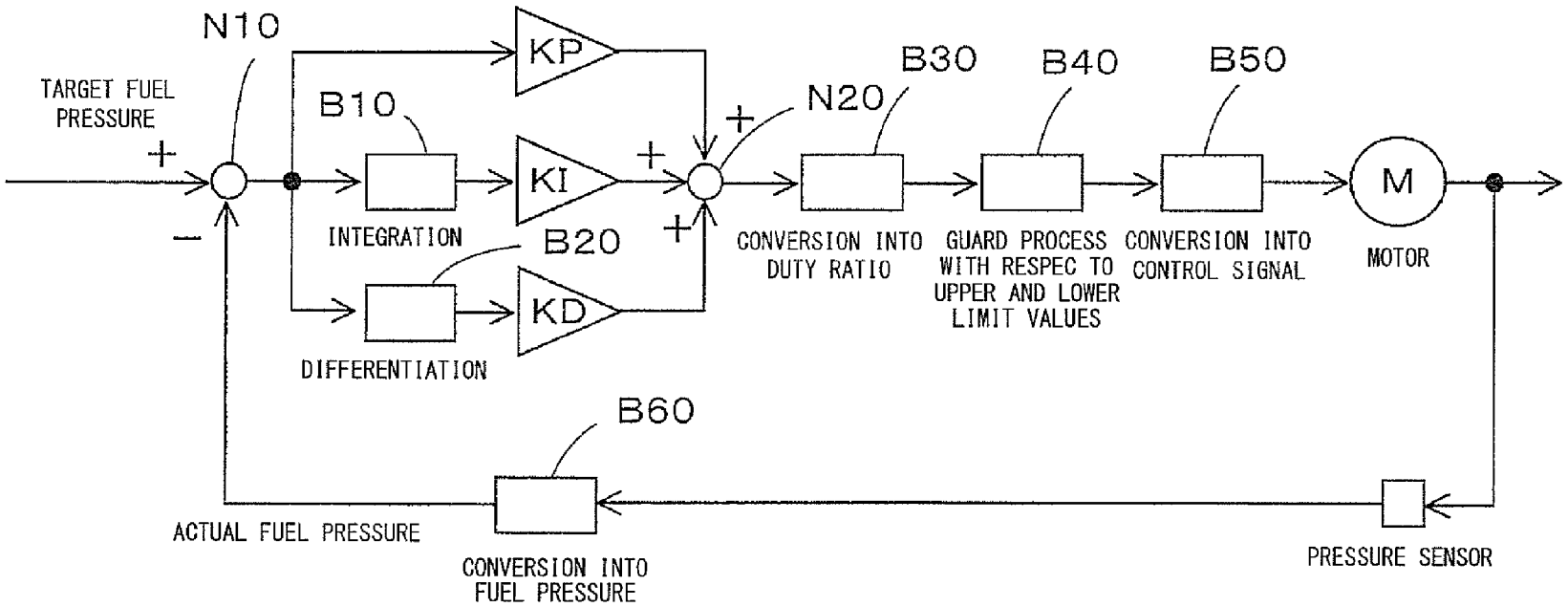
FIG. 2 is a control block diagram illustrating a feedback control for a fuel pressure in a fuel supply system according to a comparative example.
Figure 3:
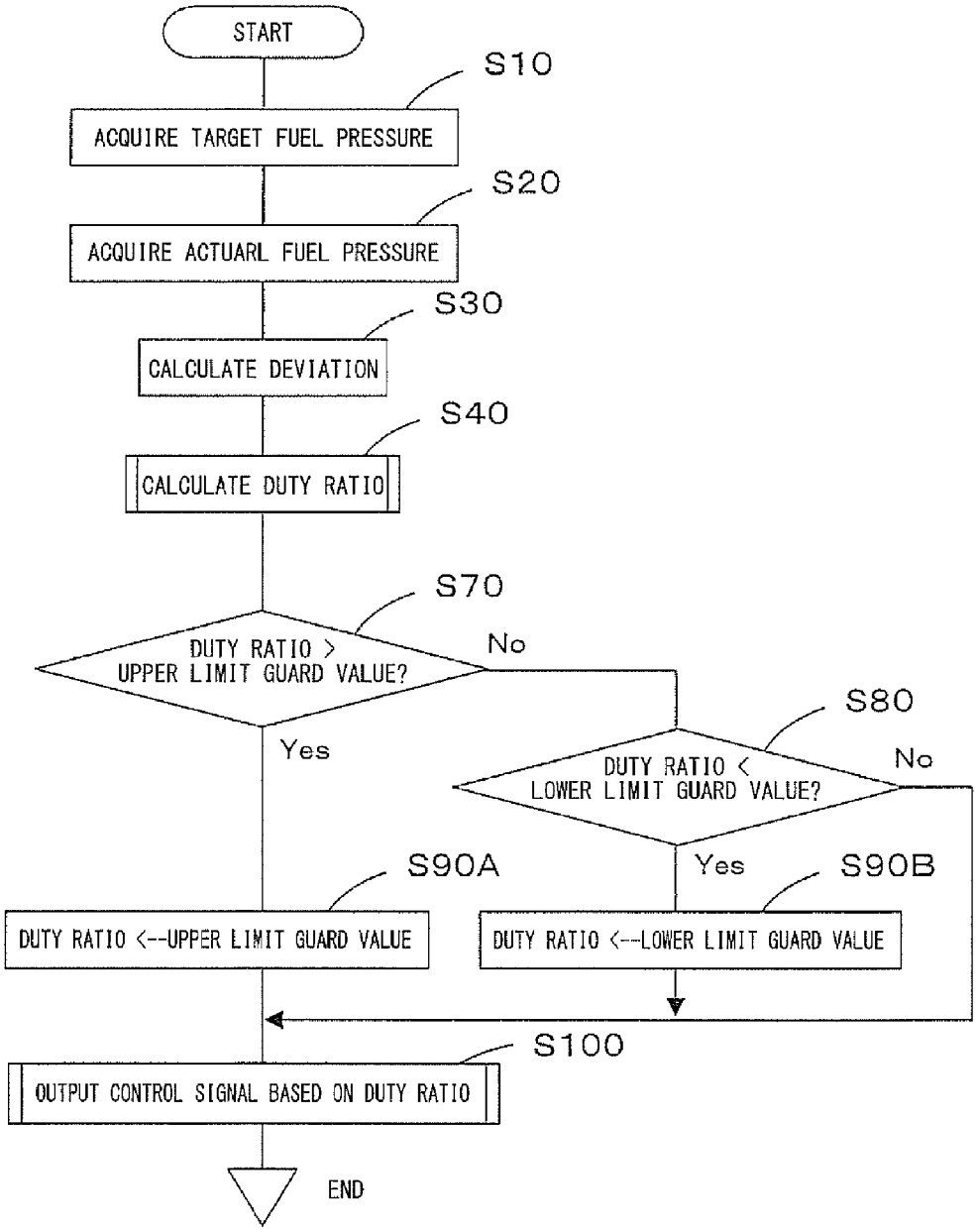
FIG. 3 is a flowchart illustrating a feedback control process for the fuel pressure in the comparative example.

As shown in the control block diagram of FIG. 2, a detection signal from a pressure sensor that detects the pressure of fuel discharged from the low-pressure pump unit may be inputted to a block B60, and the block B60 may convert the inputted detection signal to an actual fuel pressure (see Step S20 in FIG. 3). The actual fuel pressure outputted from the block B60 may be inputted to a node N10 as a subtraction term. Further, a target fuel pressure from an ECU may be inputted to the node N10 as an addition term. (In Step S10 in FIG. 3, the target fuel pressure may be acquired from the ECU, and the acquired target fuel pressure may be inputted to the node N10.) The node N10 may output a pressure deviation ΔP which is the difference between the target fuel pressure and the actual fuel pressure (see Step S30 in FIG. 3).

The pressure deviation ΔP outputted from the node N10 may be converted into a proportion control amount via a gain KP, and may be inputted to a node N20 as an addition term. Further, the pressure deviation ΔP may be converted into an integral control amount via a block B10 and a gain KI before being inputted to the node N20 as an addition term. Further, the pressure deviation ΔP may be converted into a differential control amount via a block B20 and a gain KD before being inputted to the node N20 as an addition term. A control amount obtained through addition of the proportion control amount, the integral control amount, and the differential control amount may be outputted from the node N20 to a block B30. At the block B30, the inputted control amount may be converted into a duty ratio that is outputted to a block B40 (see Step S40 in FIG. 3).

At the block B40, the upper limit guard process of the duty ratio (see Steps S70 and S90A in FIG. 3), and the lower-limit guard process (see Steps S80 and S90B in FIG. 3) may be performed such that the inputted duty ratio becomes within a predetermined range. The upper and lower-limit-guarded duty ratio may be inputted to a block B50. In the example of FIGS. 2 and 3, the upper limit guard value is a fixed value, and the upper limit guard value does not increase or decrease (e.g., the upper limit guard value=the upper limit predetermined value=99 [%] (constant)).

At the block B50, the inputted duty ratio may be converted into a motor control signal (e.g., a PWM signal) for the low-pressure fuel pump unit, and the converted control signal may be outputted to the motor (see Step S100 of FIG. 3). Then, a fuel pressure according to the motor output may be inputted to the pressure sensor.

In the comparative example described above, no specific control is performed for inhibiting the motor rotational speed from exceeding the upper limit rotational speed. Therefore, when, for example, the target fuel pressure increases abruptly, the duty ratio may abruptly increase, thereby resulting in the motor rotational speed temporarily exceeding the upper limit rotational speed. If the motor rotational speed exceeds the upper limit rotational speed, it may be possible that the motor undergoes step-out, or the wear amount of the motor bearings increases, which is not desirable.

Figure 4:
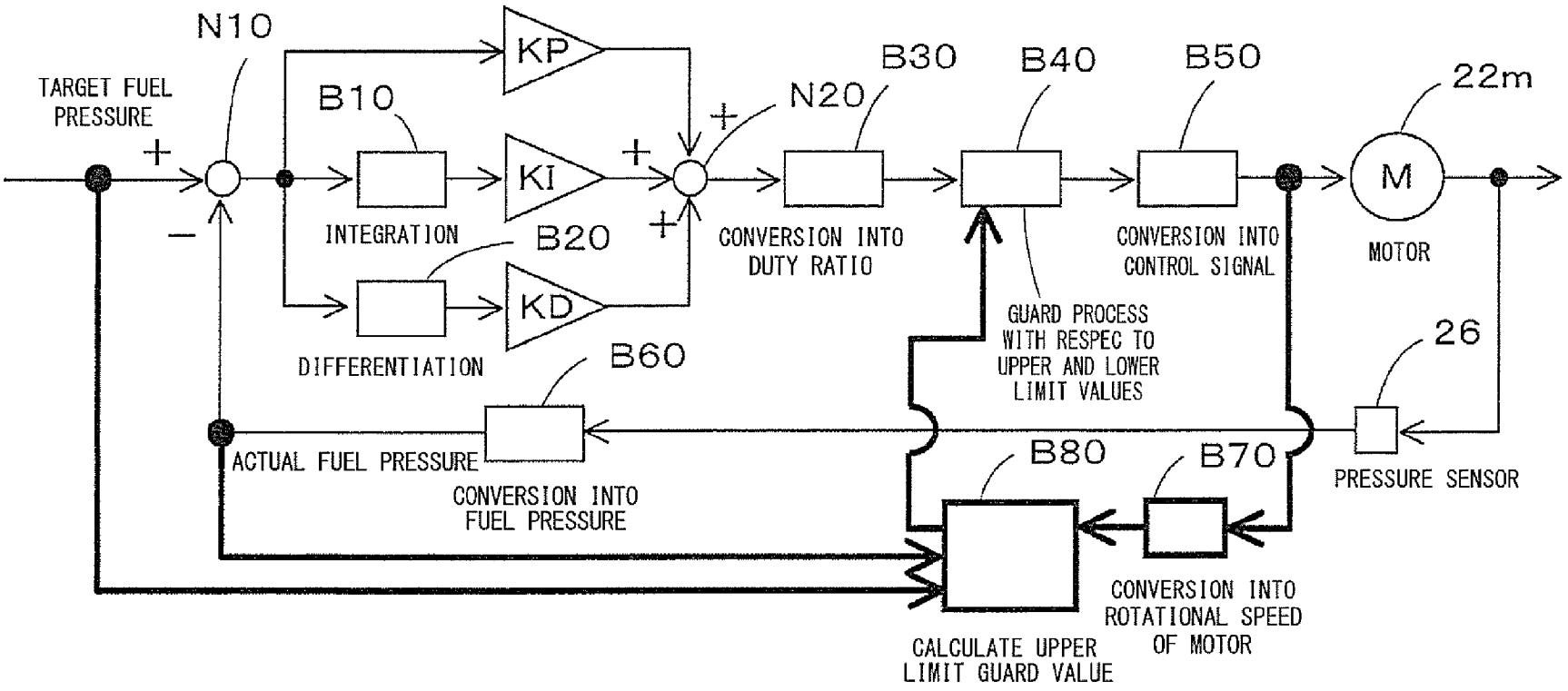
FIG. 4 is a control block diagram illustrating a feedback control for a fuel pressure in a fuel supply system according to a first embodiment.

FIG. 4 shows a control block diagram performed by the low-pressure fuel pump unit 20 and the low-pressure controller 24 according to a first embodiment. The control block diagram of the first embodiment (FIG. 4) differs from the control block diagram of the comparative example (FIG. 2) in that there are added blocks B70 and B80 and that an upper limit guard value calculated at the block B80 is used at the block B40. In addition, the control block diagram of the first embodiment differs from that of the comparative example in that the upper guard value is increased or decreased based on the motor rotational speed, the target fuel pressure, and the actual fuel pressure. Further, the flowchart shown in FIG. 5 differs from the flowchart shown in FIG. 3 in that Step S50 (which corresponds to the blocks B70 and B80 in FIG. 4) is added. FIG. 6 shows the details of the process performed in SB100 of Step S50. In the following, the process performed in SB100 shown in FIG. 6 will be described. The process shown in FIG. 5 may be started, for example, at predetermined time intervals.

In Step SB110 in FIG. 6, the low-pressure controller 24 may estimate the rotational speed of the motor 22*m* based on the control signal that may be outputted from the low-pressure controller 24. The control signal may be outputted from the block B50 to the motor 22*m*. The process may then proceeds to Step SB120. It may be also possible to provide a motor rotational speed detection device. In such a case, the rotational speed of the motor 22*m* may be detected based on a detection signal of the motor rotational speed detection device.

In Step SB120, the low-pressure controller 24 may determine whether or not the motor rotational speed is higher than a first rotational speed. If the motor rotational speed is higher than the first rotational speed ("Yes"), the process proceeds to Step SB130. If the motor rotational speed is not higher than (i.e., less than or equal to) the first rotational speed ("No"), the process proceeds to Step SB140. The first rotational speed may be set to be lower than and close to the upper limit rotational speed of the motor 22*m*. A second rotational speed described later may be lower than the first rotational speed. For example, if the upper limit rotational speed of the motor 22*m* is 10,000 revolutions per minute (rpm), the first rotational speed may be set to approximately 9,500 (rpm), and the second rotational speed may be set to approximately 9,000 (rpm).

Figure 7:
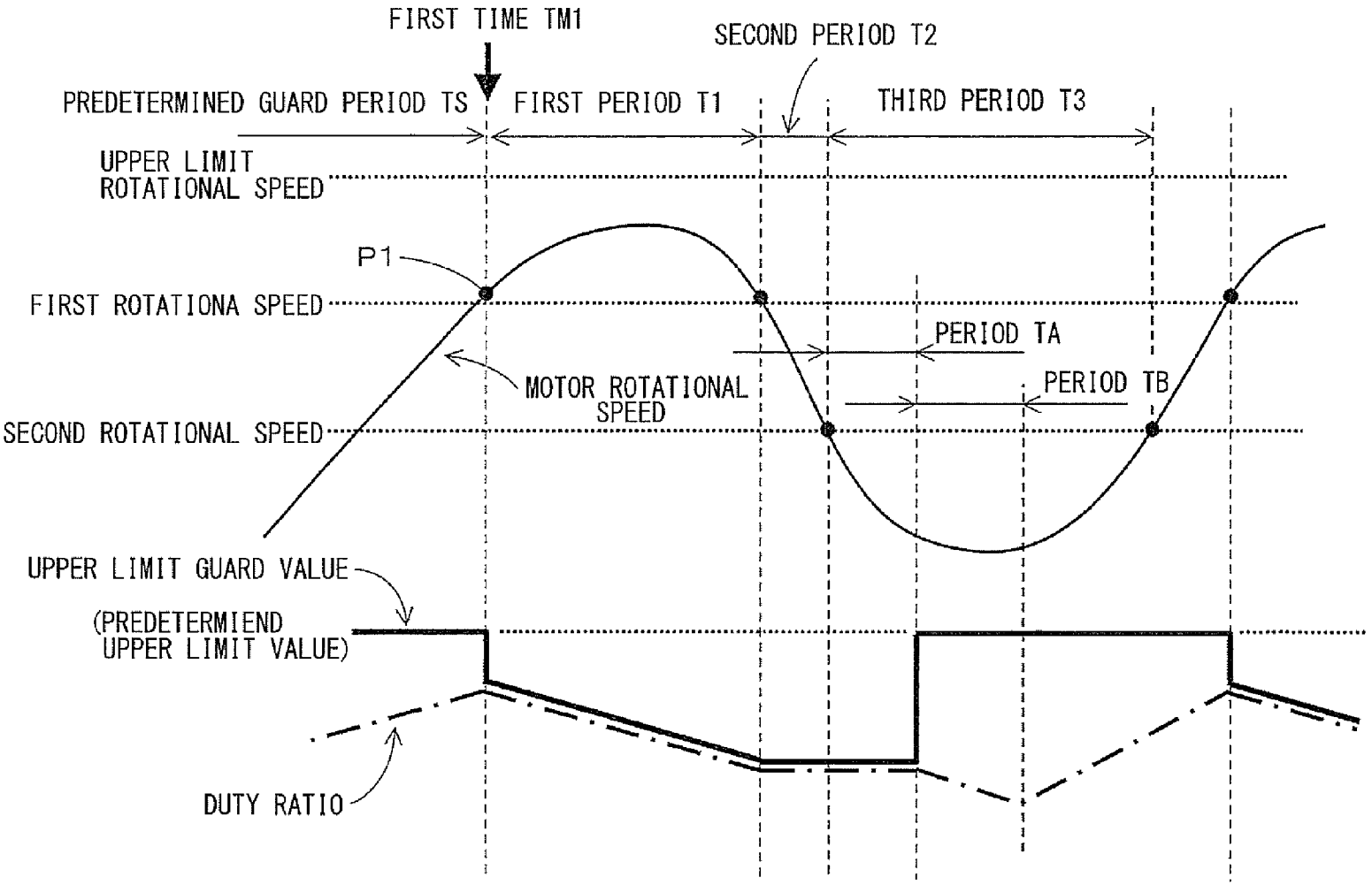
FIG. 7 is a graph illustrating changes with time a motor rotational speed, a duty ratio, and an upper limit guard value in the fuel supply system according to the first embodiment.

In the case that the process proceeds to Step SB130, the low-pressure controller 24 may determine whether or not it is at a first time TM1. If it is at the first time TM1 ("Yes"), the process proceeds to Step SB190A. If it is not at the first time TM1 ("No"), the process proceeds to Step SB190B. As shown in FIG. 7, the first time TM1 is the time when the motor rotational speed, having increased from a level below the first rotational speed, exceeds the first rotational speed (see point P1). For example, immediately before the completion of the process in Step SB100 (at the last stage of the process in step SB100), the low-pressure controller 24 may store the result of determination as to whether or not the motor rotational speed is not higher than (i.e., less than or equal to) the first rotational speed. If the stored determination is that the motor rotational speed is not higher than the first rotational speed, it may be determined in the next cyclic process that it is at the first time TM1 in Step SB130.

In a predetermined guard period TS which is the period until the first time TM1 (see FIG. 7), the upper limit guard value may be set to an upper limit predetermined value (e.g., 99%).

In the case that the process has proceeded to Step SB190A (in the case of the first time TM1), the low-pressure controller 24 may substitute (set) the value of the duty ratio at that point in time for the upper limit guard value (see FIG. 7) to complete the process.

In the case that the process has proceeded to Step SB190B (in the case of a first period T1), the low-pressure controller 24 may attenuate (subtract) the upper limit guard value by a predetermined amount (see FIG. 7) to complete the process. The first period T1 is a period after the first time TM1, in which the motor rotational speed is in excess of the first rotational speed (see FIG. 7).

In the case that the process has proceeded to Step SB140, the low-pressure controller 24 may determine whether or not the motor rotational speed is less than the second rotational speed. If the motor rotational speed is less than the second rotational speed ("Yes"), the process proceeds to Step SB150. If the motor rotational speed is not less than (i.e., greater than or equal to) the second rotational speed ("No") (in the case of a second period T2), the process is completed (i.e., the upper limit guard value is maintained without being updated). The second period T2 is the period after the first period T1, and in the second period T2, the motor rotational speed is not more than (i.e., less than or equal to) the first rotational speed and not less than (i.e., greater than or equal to) the second rotational speed (see FIG. 7).

In the case that the process has proceeded to Step SB150 (in the case of a third period T3), the low-pressure controller 24 may determine whether or not the target fuel pressure is less than the actual fuel pressure. If the target fuel pressure is less than the actual fuel pressure ("Yes") (which corresponds to a period TB in FIG. 7), the process proceeds to Step SB190C. If the target fuel pressure is not less than (i.e., greater than or equal to) the actual fuel pressure ("No") (which corresponds to a period TA in FIG. 7), the process is completed (i.e., the upper and lower limit guard values are maintained without being updated). The third period T3 is a period after the second period T2 and, in the third period T3, the motor rotational speed is less than the second rotational speed. The period TA is a part of the third period T3 and, in the period TA, the target fuel pressure is not less than (i.e., greater than or equal to) the actual pressure. The period TB is also a part of the third period and, and in the period TB, the target fuel pressure is less than the actual fuel pressure.

In the case that the process has proceeded to Step SB190C (in the case of the period TB in FIG. 7), the low-pressure controller 24 may substitute (set) an upper limit predetermined value (e.g., 99%) for the upper limit guard value to complete the process.

As shown in FIG. 7, in the first embodiment described above, at the point P1 in time of the first time TM1 when the motor rotational speed exceeds the first rotational speed, the duty ratio at that point P1 in time may be used as the upper limit guard value, thereby suppressing an increase in the duty ratio. In addition, during the first period T1, the upper limit guard value may gradually decrease, whereby an increase in the duty ratio is suppressed. Thus, at the first time TM1 and during the first period T1 when the motor rotational speed exceeds the first rotational speed, it is possible to reduce the duty ratio so that the motor rotational speed may not reach the upper limit rotational speed. Further, if the target fuel pressure becomes less than the actual fuel pressure (in the case of the period TB of FIG. 7) during the third period T3 when the motor rotational speed is less than the second rotational speed, the upper guard value may be restored to the upper limit predetermined value, making it possible to restore the reduced upper limit guard value to the upper limit predetermined value at an appropriate time.

Figure 5:
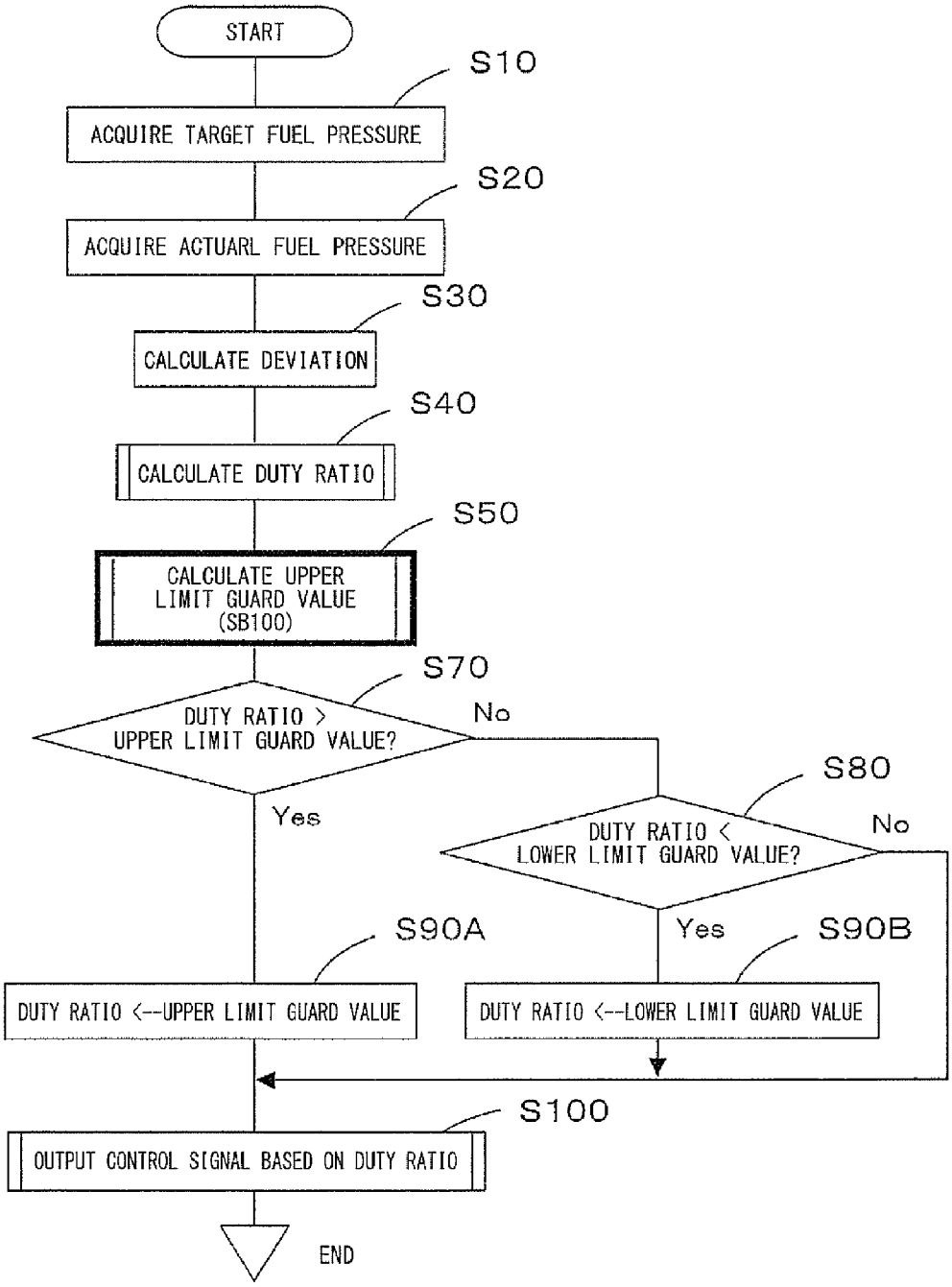
FIG. 5 is a flowchart illustrating a feed back control process for the fuel pressure in the fuel supply system according to the first embodiment.
Figure 6:
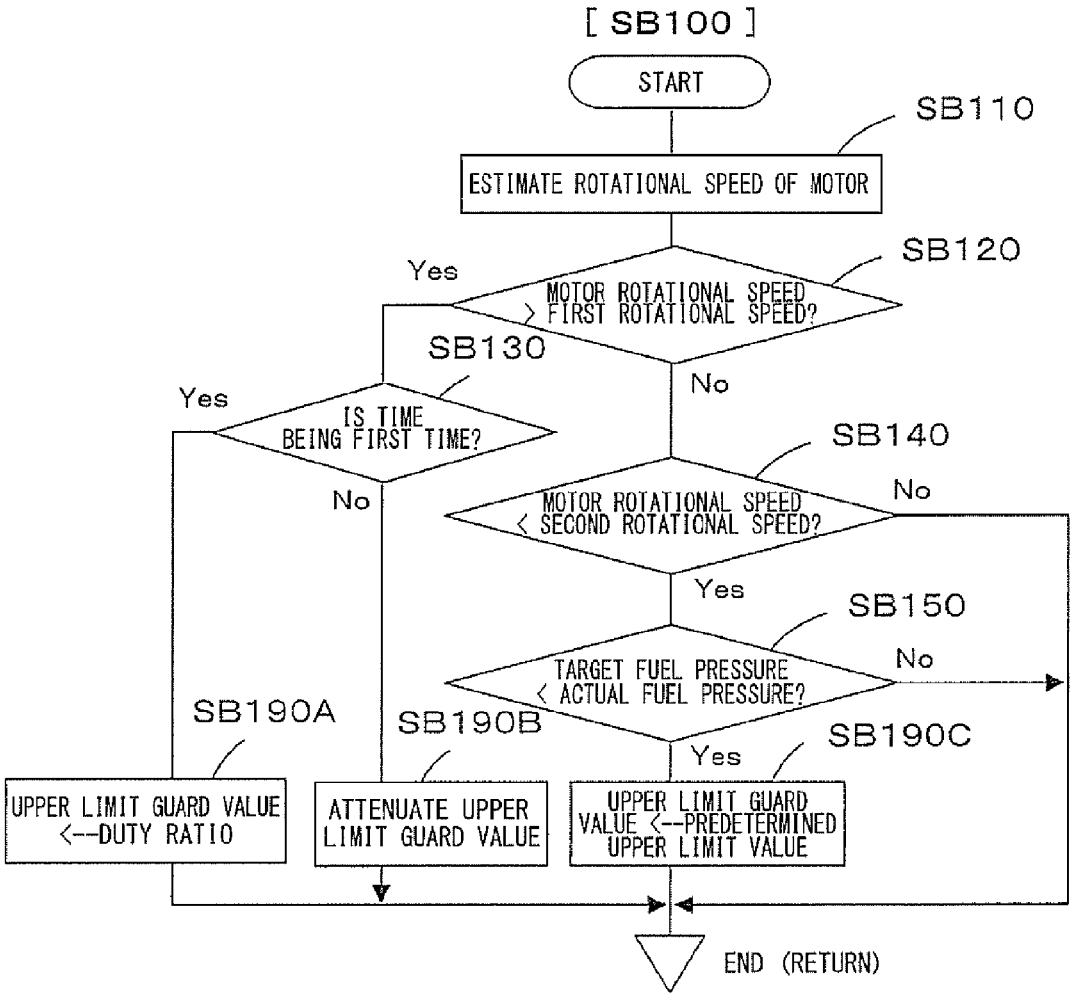
FIG. 6 is a flowchart illustrating a process executed in Step S50 (SB100) in FIG. 5.

In step S40 in FIG. 5, the low-pressure controller 24 may calculate the duty ratio from the target fuel pressure and information on the actual fuel pressure. Here, the information on the actual fuel pressure may, for example, be the fuel pressure obtained from the detection signal acquired from the pressure sensor 26, the fuel pressure estimated from the operation condition of the internal combustion engine E or the rotational speed of the motor 22*m*, etc., or the fuel pressure signal received from the ECU 40.

Figure 8:
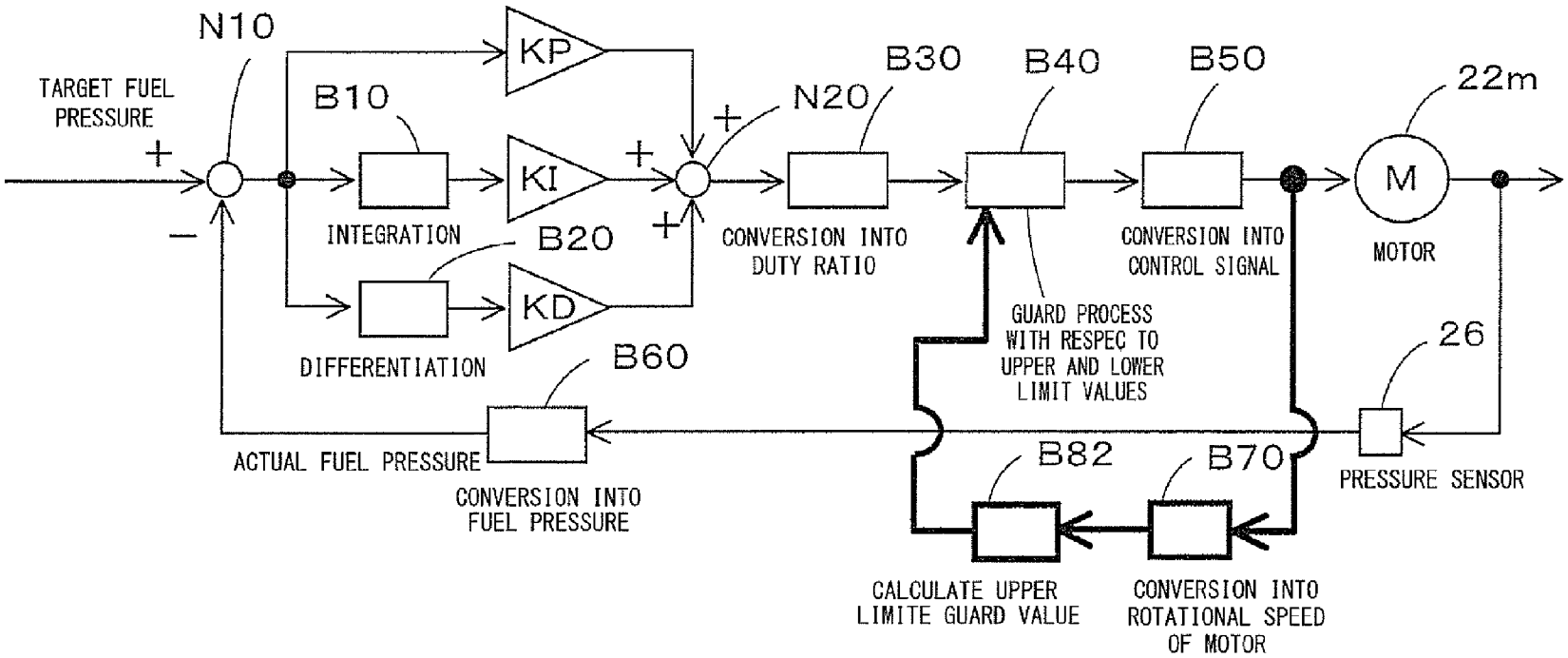
FIG. 8 is a control block diagram illustrating a feedback control for a fuel pressure in a fuel supply system according to a second embodiment.
Figure 9:
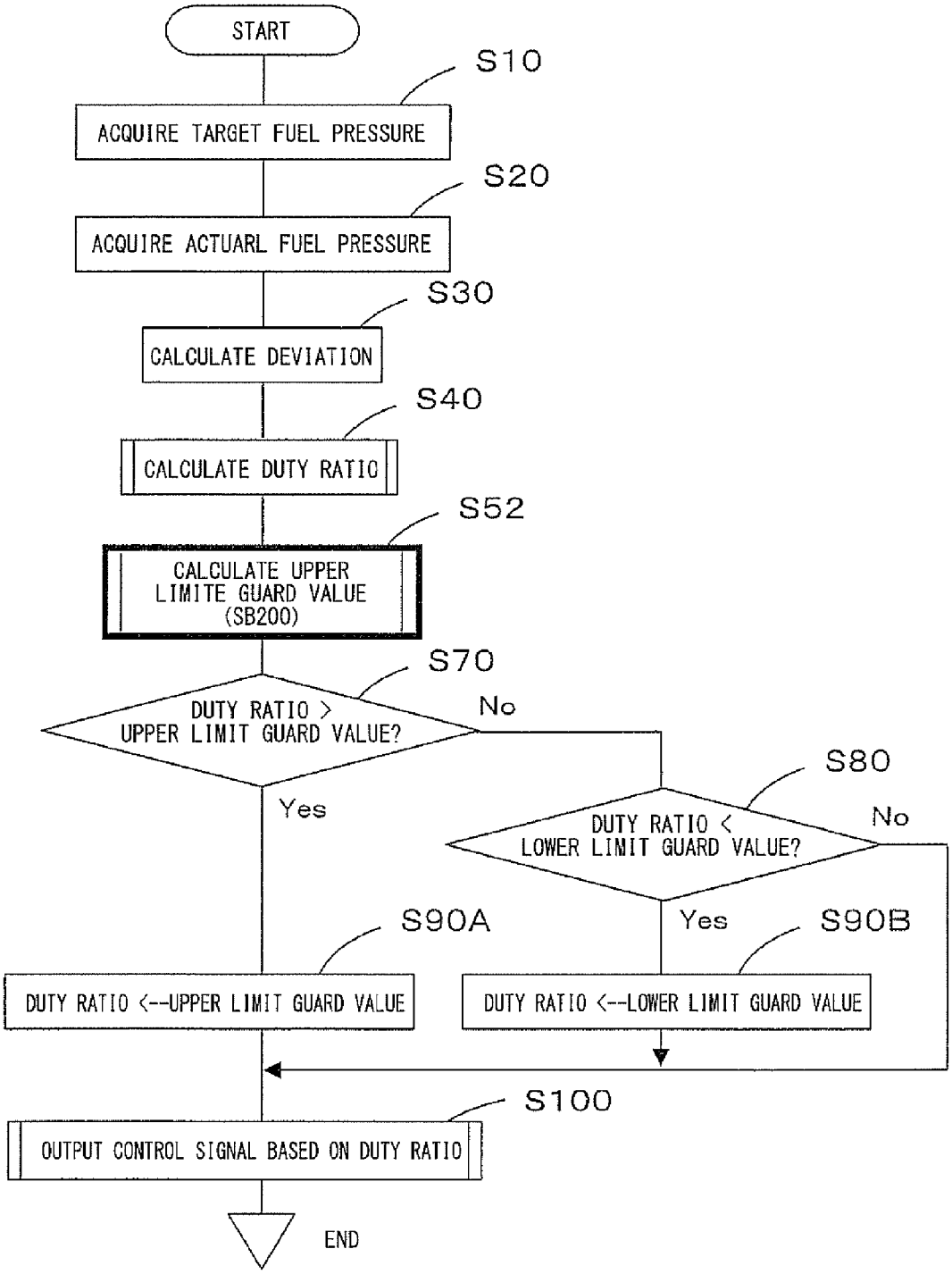
FIG. 9 is a flowchart illustrating a feed back control process for the fuel pressure in the fuel supply system according to the second embodiment.
Figure 10:
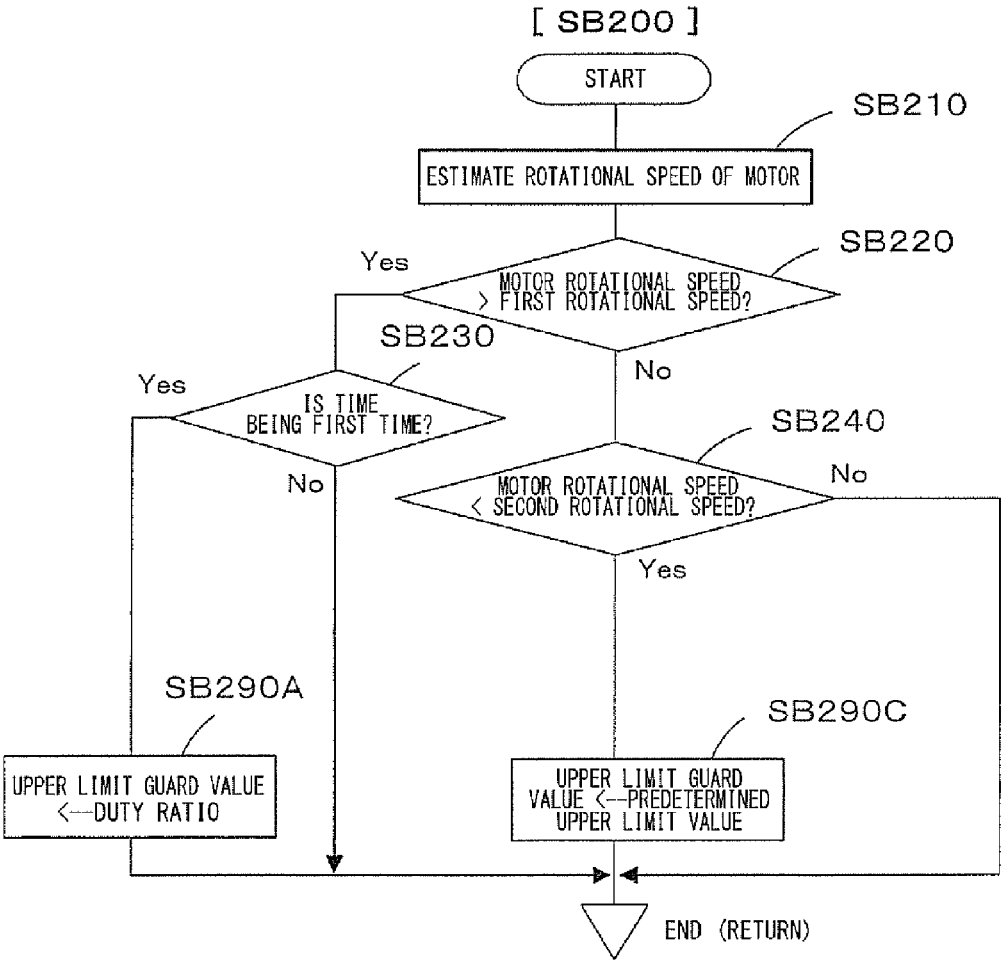
FIG. 10 is a flowchart illustrating a process executed in Step S52 (SB200) in FIG. 9.

FIG. 8 shows a control block diagram of a process performed according to a second embodiment. The control block diagram of the second embodiment (FIG. 8) differs from the control block diagram (FIG. 2) of the comparative example in that blocks B70 and B82 are added and that the upper limit guard value calculated in the block B82 is used in the block B40. In addition, the control process of the second embodiment differs from that of the comparative example in that the upper limit guard value is increased or decreased based on the motor rotational speed. Further, the flowchart shown in FIG. 9 differs from the flowchart shown in FIG. 3 in that Step S52 (which corresponds to the block B70, B82 of FIG. 8) is added. FIG. 10 shows the details of the process performed in SB200 of step S52. In the following, the process performed in SB200 shown in FIG. 10 will be described. The process shown in FIG. 9 may be started, for example, at predetermined time intervals.

In step SB210 shown in FIG. 10, the low-pressure controller 24 may estimate the rotational speed of the motor 22*m* in the same manner as in Step SB110 shown in FIG. 6, and the process proceeds to Step SB220. As described in connection with Step SB110, it may be also possible to provide a motor rotational speed detection device, and the rotational speed of the motor 22*m* may be detected based on a detection signal from the motor rotational speed detection device. In the following, the upper limit rotational speed, the first rotational speed, the second rotational speed, the first time TM1, the first period T1, the second period T2, the third period T3, etc. are the same as those described in connection with the first embodiment, so a description thereof will be omitted.

In Step SB220, the low-pressure controller 24 may determine whether or not the motor rotational speed is higher than the first rotational speed. If the motor rotational speed is higher than the first rotational speed ("Yes"), the process proceeds to Step SB230. If the motor rotational speed is not higher than (i.e., less than or equal to) the first rotational speed ("No"), the process proceeds to Step SB240.

In the case that the process has proceeded to Step SB230, the low-pressure controller 24 may determine whether or not it is at the first time T1. If it is at the first time T1 ("Yes"), the process proceeds to Step SB290A. If it is not at the first time T1 ("No") (in the case of the first period T1), the process is completed (i.e., the upper limit guard value is maintained without being updated).

During the predetermined guard period TS (see FIG. 11), which is the period up to the first time T1, the upper limit guard value may be set to an upper limit predetermined value (e.g., 99%).

In the case that the process has proceeded to Step SB290A (in the case of the point P1 in time of the first time T1), the low-pressure controller 24 may substitute (set) the value of the duty ratio at that point in time for the upper limit guard value (see FIG. 11) to complete the process.

In the case that the process has proceeded to Step SB240, the low-pressure controller 24 may determine whether or not the motor rotational speed is less than the second rotational speed. If the motor rotational speed is less than the second rotational speed ("Yes"), the process proceeds to Step SB290C. If the motor rotational speed is not less than (i.e., greater than or equal to) the second rotational speed ("No") (in the case of the second period T2), the process is completed (i.e., the upper limit guard value is maintained without being updated).

In the case that the process has proceeded to Step SB290C (in the case of the third period T3), the low-pressure controller may substitute (set) the upper limit predetermined value (e.g., 99%) for the upper limit guard value to complete the process.

Figure 11:
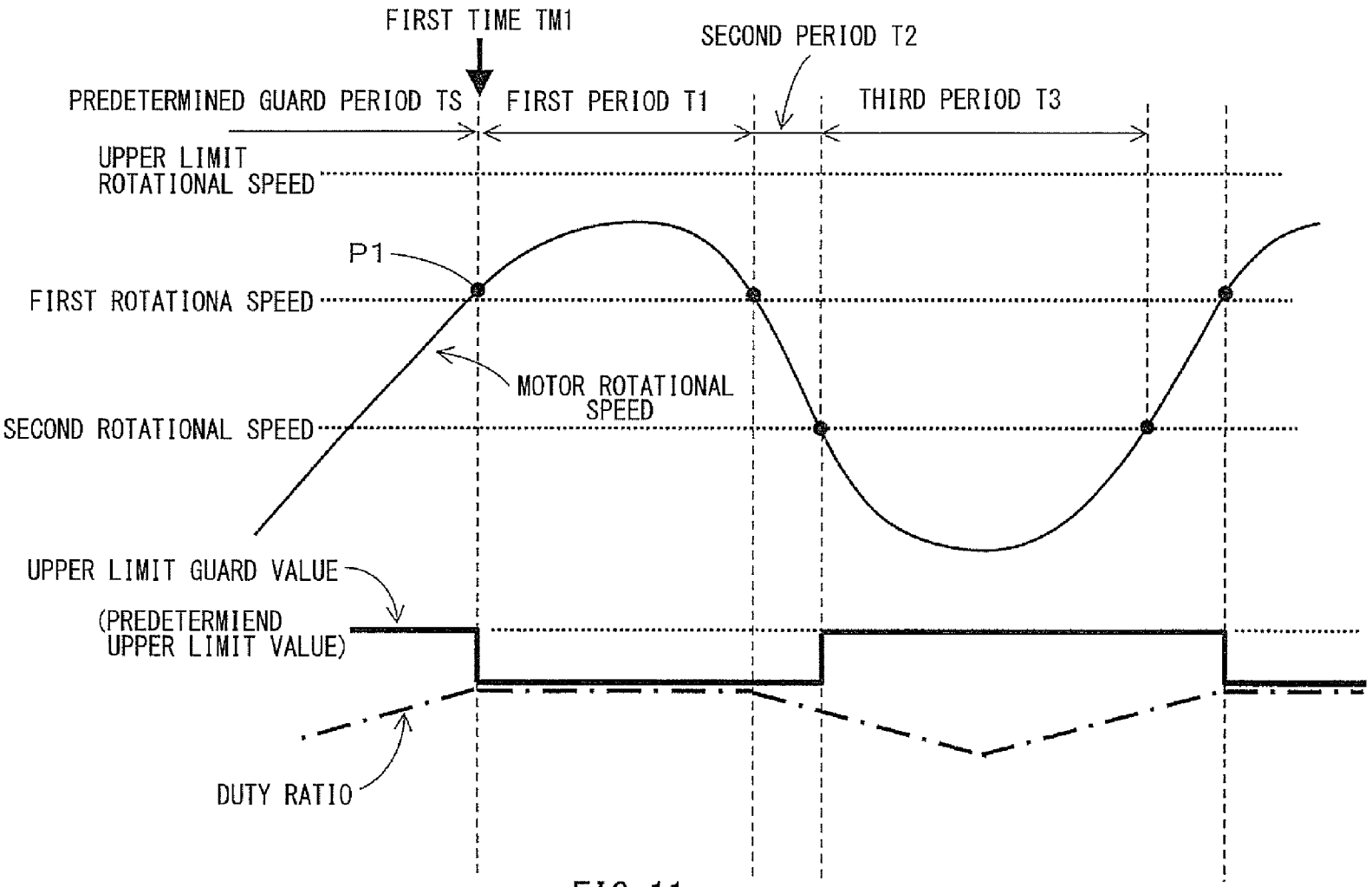
FIG. 11 is a graph illustrating changes with time a motor rotational speed, a duty ratio, and an upper limit guard value in the fuel supply system according to the second embodiment.

As shown in FIG. 11, in the second embodiment described above, at the point P1 in time of the first time TM1 when the motor rotational speed exceeds the first rotational speed, the duty ratio at that point in time may be used as the upper limit guard value, whereby an increase in the duty ratio may be suppressed. In addition, during the first period T1, the upper limit guard value may be maintained. Thus, at the first time TM1 and during the first period T1 when the motor rotational speed exceeds the first rotational speed, it is possible to suppress a further increase in the duty ratio so that the motor rotational speed may not reach the upper limit rotational speed. Further, during the third period T3 when the motor rotational speed is less than the second rotational speed, the upper limit guard value may be restored to the upper limit predetermined value, making it possible to restore the reduced upper limit guard value to the upper limit predetermined value at an appropriate time.

Figure 12:
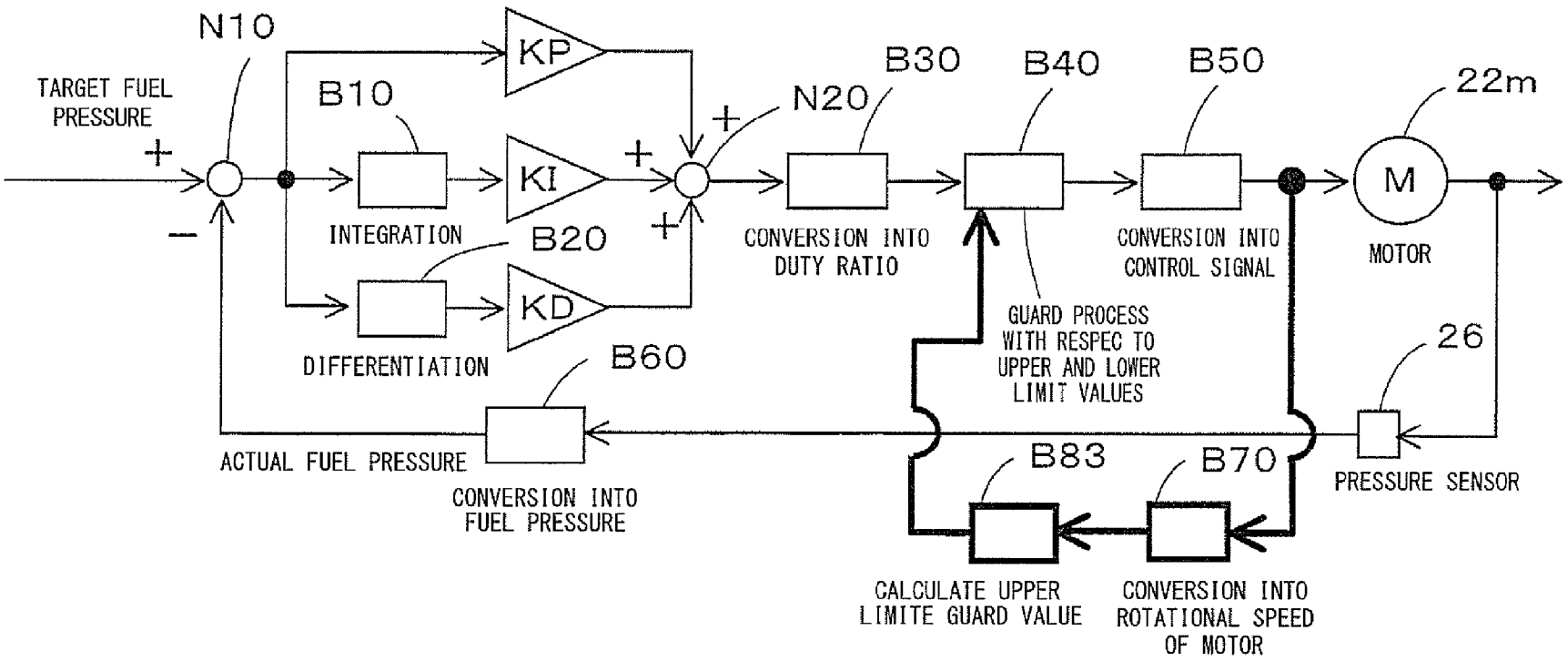
FIG. 12 is a control block diagram illustrating a feedback control for a fuel pressure in a fuel supply system according to a third embodiment.
Figure 13:
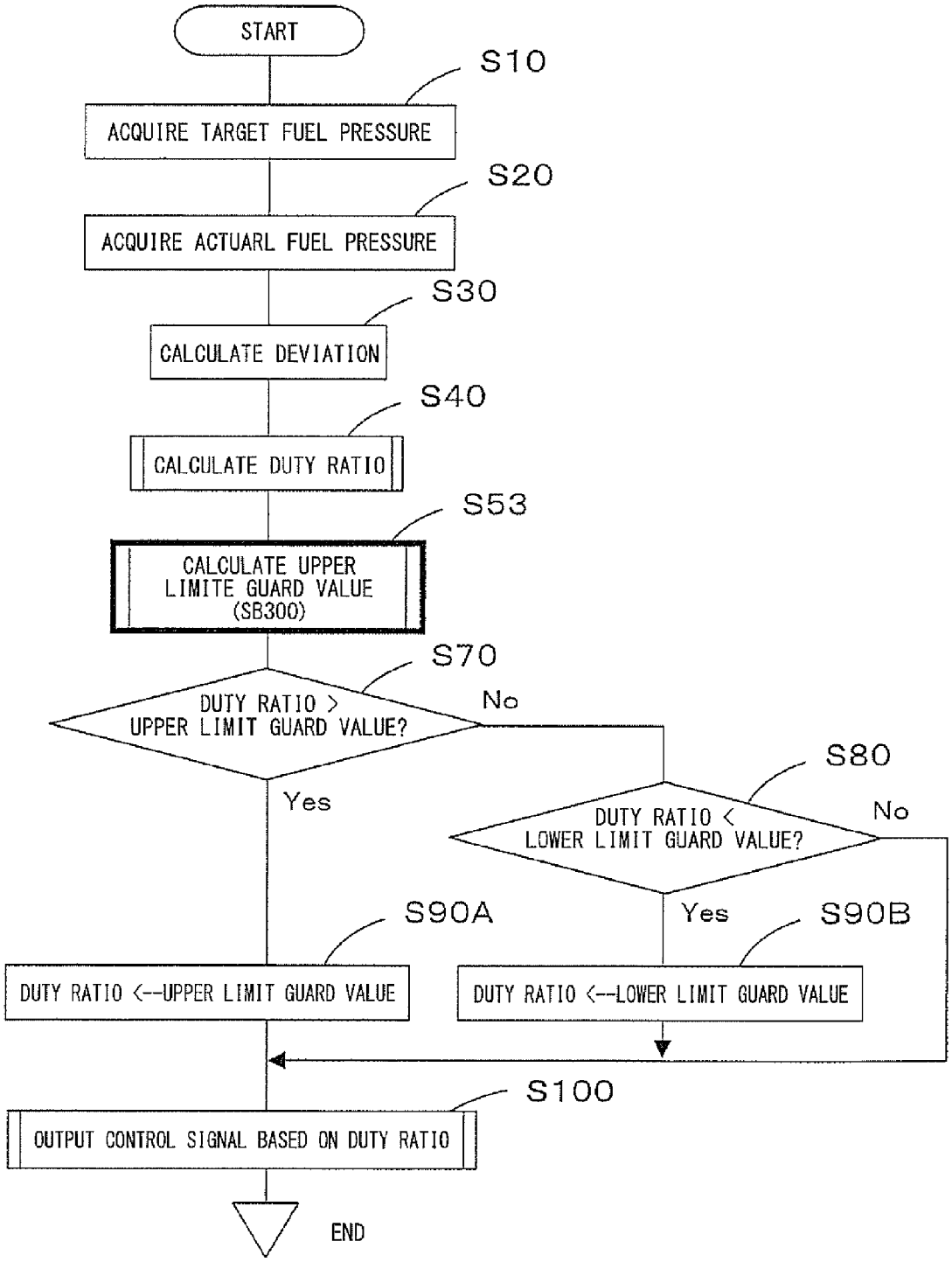
FIG. 13 is a flowchart illustrating a feed back control process for the fuel pressure in the fuel supply system according to the third embodiment.
Figure 14:
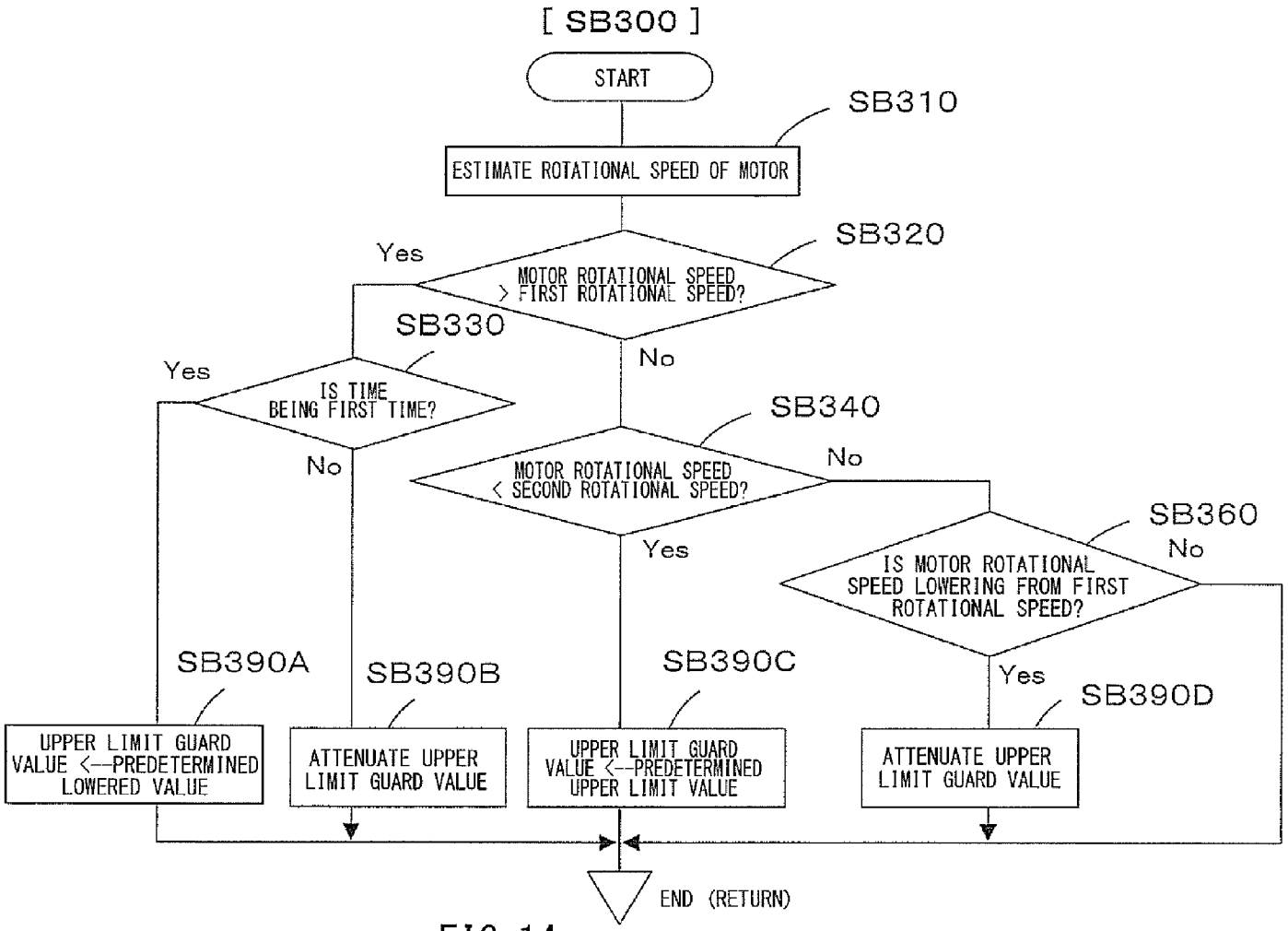
FIG. 14 is a flowchart illustrating a process executed in Step S53 (SB300) in FIG. 13.

FIG. 12 shows a control block diagram of a process performed according to a third embodiment. The control block diagram of the third embodiment (FIG. 12) differs from the control block diagram of the comparative example (FIG. 2) in that blocks B70 and B83 are added and that an upper limit guard value calculated at the block B83 is used at the block B40. In addition, the control process of the third embodiment differs from that of the comparative example in that the upper limit guard value is increased and decreased based on the motor rotational speed. Further, the flowchart shown in FIG. 13 differs from the flowchart shown in FIG. 3 in that Step S53 (which corresponds to the blocks B70 and B83 of FIG. 12) is added. FIG. 14 shows the details of the process performed in SB300 of Step S53. In the following, the process performed in SB300 shown in FIG. 14 will be described. The process shown in FIG. 13 may be started, for example, at predetermined time intervals.

In Step SB310 shown in FIG. 14, the low-pressure controller may estimate the rotational speed of the motor 22*m* in the same manner as in step SB100 shown in FIG. 6. The process may then proceed to Step SB320. As described in connection with Step SB110, it may be also possible to provide a motor rotational speed detection device, and the rotational speed of the motor 22*m* may be detected based on a detection signal from the motor rotational speed detection device. In the following, the upper limit rotational speed, the first rotational speed, the second rotational speed, the first time TM1, the first period T1, the second period T2, the third period T3, etc. are the same as those described in connection with the first embodiment, so a description thereof will be omitted.

In Step SB320, the low-pressure controller 24 may determine whether or not the motor rotational speed is higher than the first rotational speed. If the motor rotational speed is higher than the first rotational speed ("Yes"), the process proceeds to Step SB330. If the motor rotational speed is not higher than (i.e., less than or equal to) the first rotational speed ("No"), the process proceeds to Step SB340.

In the case that the process has proceeded to Step SB330, the low-pressure controller may determine whether or not it is at the first time TM1. If it is at the first time TM1 ("Yes"), the process proceeds to Step SB390A. If it is not at the first time TM1 ("No") (in the case of the first period T1), the process proceeds to Step SB390B.

During the predetermined guard period TS (see FIG. 15) which is a period up to the first time TM1, the upper limit guard value may be set to the upper limit value (e.g., 99%).

In the case that the process has proceeded to Step SB390A (in the case of the first time TM1), the low-pressure controller 24 may substitute (set) a predetermined lowered value lower than the upper limit predetermined value (see FIG. 15) to complete the process. When, for example, the upper limit predetermined value is 99%, the predetermined lowered value may be set to approximately 90%.

In the case that the process has proceeded to Step SB390B (in the case of the first period T1), the low-pressure controller 24 may attenuate (subtract) the upper limit guard value by a predetermined amount (see FIG. 15) to complete the process.

In the case the process has proceeded to Step B340, the low-pressure controller 24 may determine whether or not the motor rotational speed is less than the second rotational speed. If the motor rotational speed is less than the second rotational speed ("Yes"), the process proceeds to Step SB390C. If the motor rotational speed is not less than (i.e., greater than or equal to) the second rotational speed ("No") (in the case of the second period T2), the process proceeds to Step SB360.

In the case that the process has proceeded to Step SB360 (in the case of the second period T2), the low-pressure controller 24 may determine whether or not the motor rotational speed is lowering from the first rotational speed. If the motor rotational speed is lowering (decreasing) from the first rotational speed ("Yes"), the process proceeds to Step SB390D. If the motor rotational speed is not lowering (i.e., not decreasing) from the first rotational speed ("No"), the process is completed (i.e., the upper limit guard value is maintained without being updated). The determination as to whether or not it is lowering from the first rotational speed may be made by, for example, storing the motor rotational speed immediately before the completion of the process at SB300 (the last of the process at SB300), and preparing a flag. The flag may be set if the motor rotational speed is higher than the first rotational speed. The flag may be cleared if the motor rotational speed is less than the second rotational speed. Thus, in Step SB360, if the flag is set, and if the motor rotational speed at that time is lower than the stored motor rotational speed, it may be determined that the motor rotational speed is lowering (decreasing) from the first rotational speed.

In the case that the process has proceeded to Step SB390D, the low-pressure controller may attenuate (subtract) the upper limit guard value by a predetermined amount (see FIG. 15) to complete the process. The attenuation amount may be the same as that in Step SB390B or may be different from that in Step SB390B.

In the case that the process has proceeded to Step SB390C (in the case of the third period T3), the low-pressure controller 24 may substitute (set) the upper limit predetermined value (e.g., 99%) for the upper limit guard value to complete the process.

Figure 15:
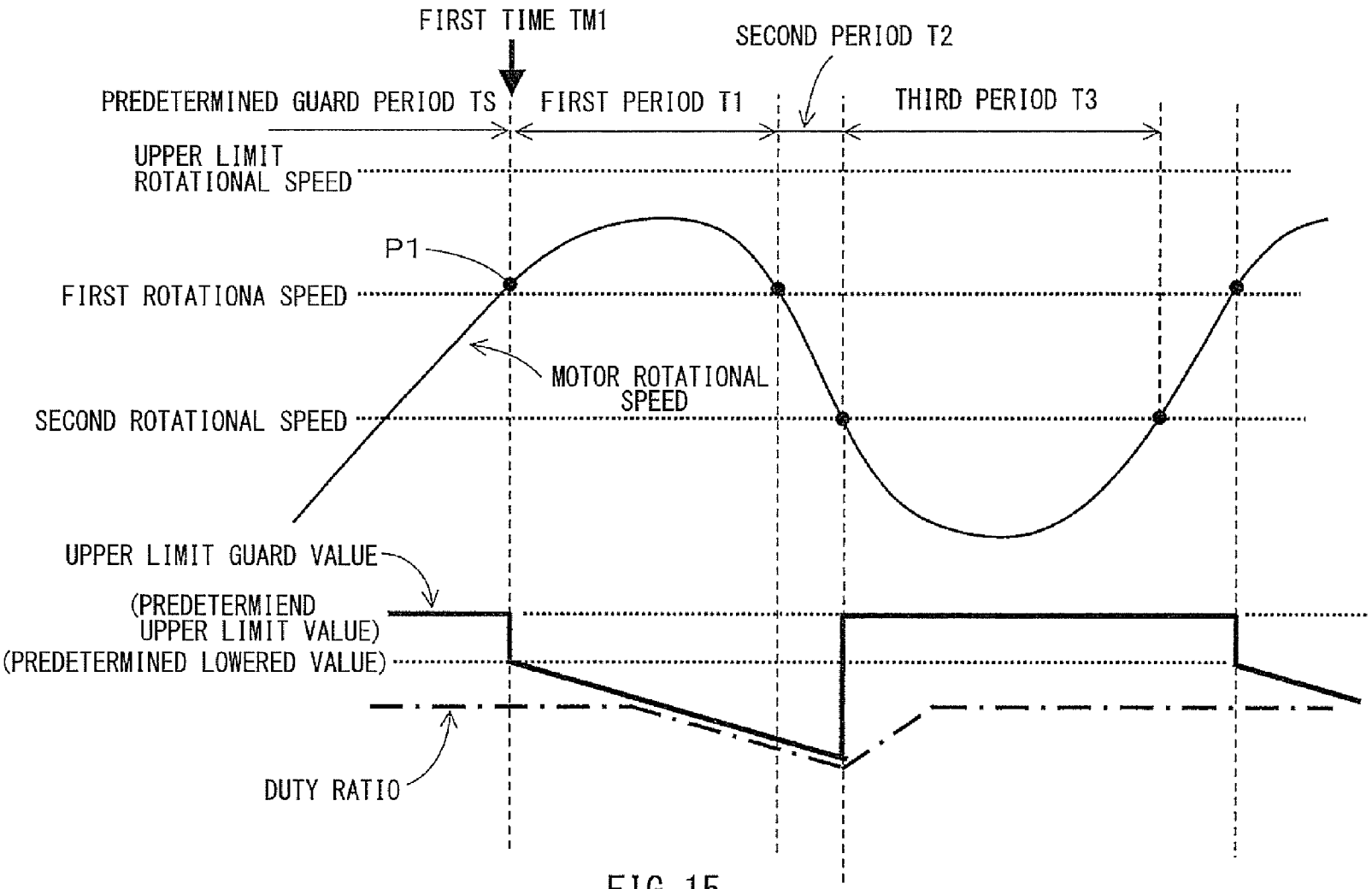
FIG. 15 is a graph illustrating changes with time a motor rotational speed, a duty ratio, and an upper limit guard value in the fuel supply system according to the third embodiment.

As shown in FIG. 15, in the third embodiment described above, at the point P1 in time of the first time TM1 when the motor rotational speed exceeds the first rotational speed, the predetermined lowered value may be set as the upper limit guard value, whereby the upper limit of the duty ratio may be suppressed. In addition, during the first period T1, the upper limit guard value may be gradually reduced, thereby gradually reducing the upper limit of the duty ratio. Thus, at the first time TM1 and during the first period T1 when the motor rotational speed exceeds the first rotational speed, it is possible to reduce the duty ratio so that the motor rotational speed may not reach the upper limit rotational speed. Further, during the third period T3 when the motor rotational speed is less than the second rotational speed, the upper guard value may be restored to the upper limit predetermined value, making it possible to restore the reduced upper limit guard value to the upper limit predetermined value at an appropriate time.

Figure 16:
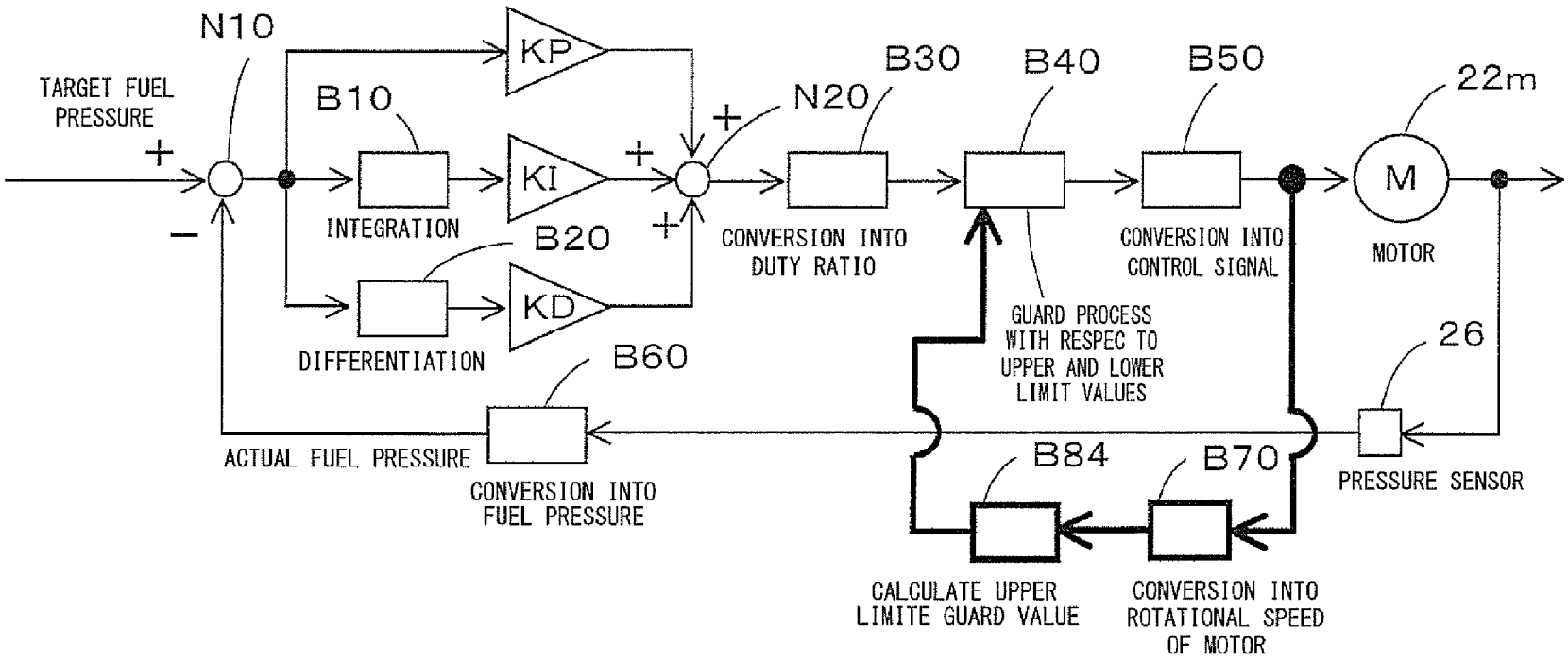
FIG. 16 is a control block diagram illustrating a feedback control for a fuel pressure in a fuel supply system according to a fourth embodiment.
Figure 17:
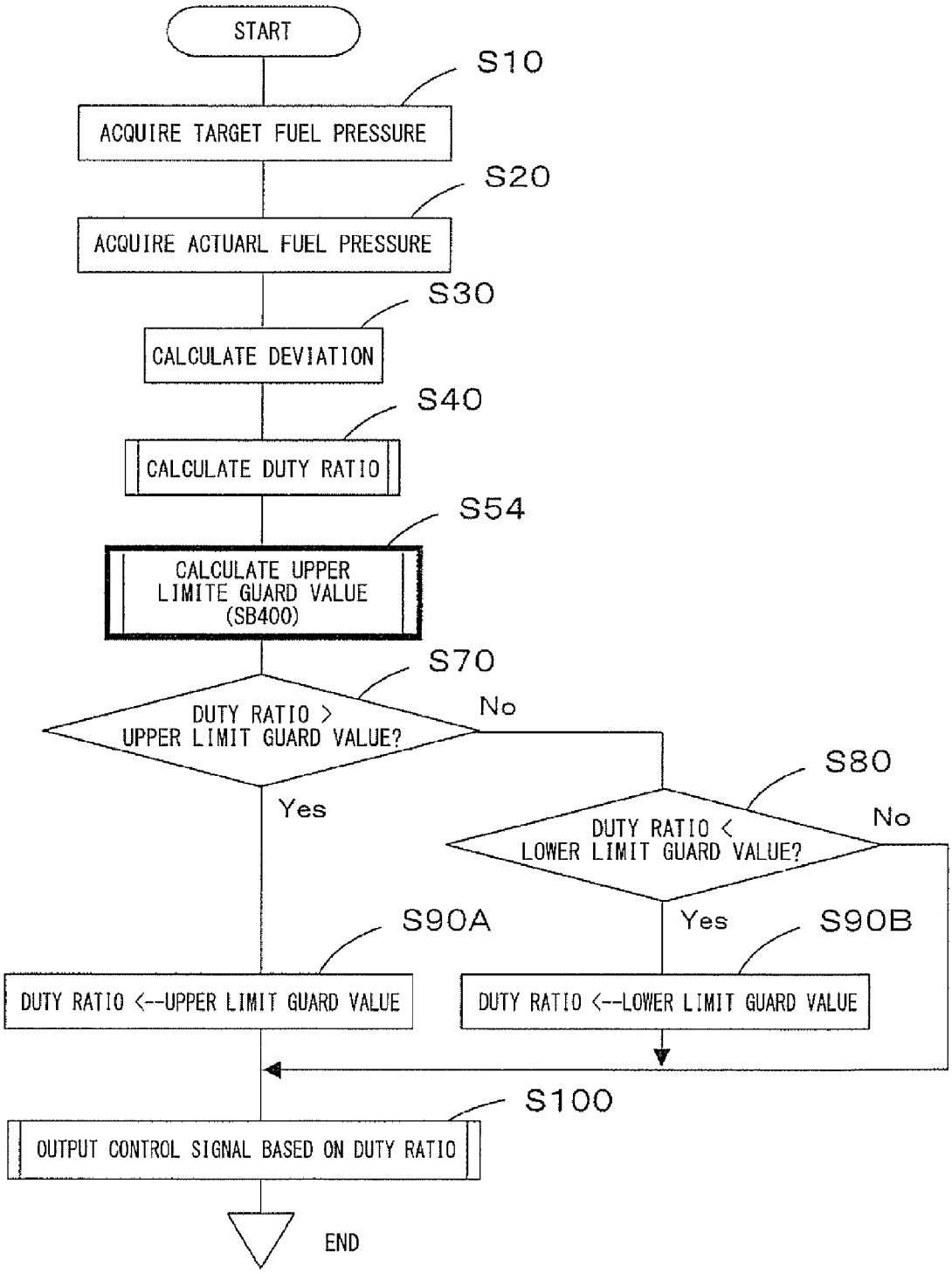
FIG. 17 is a flowchart illustrating a feed back control process for the fuel pressure in the fuel supply system according to the fourth embodiment.
Figure 18:
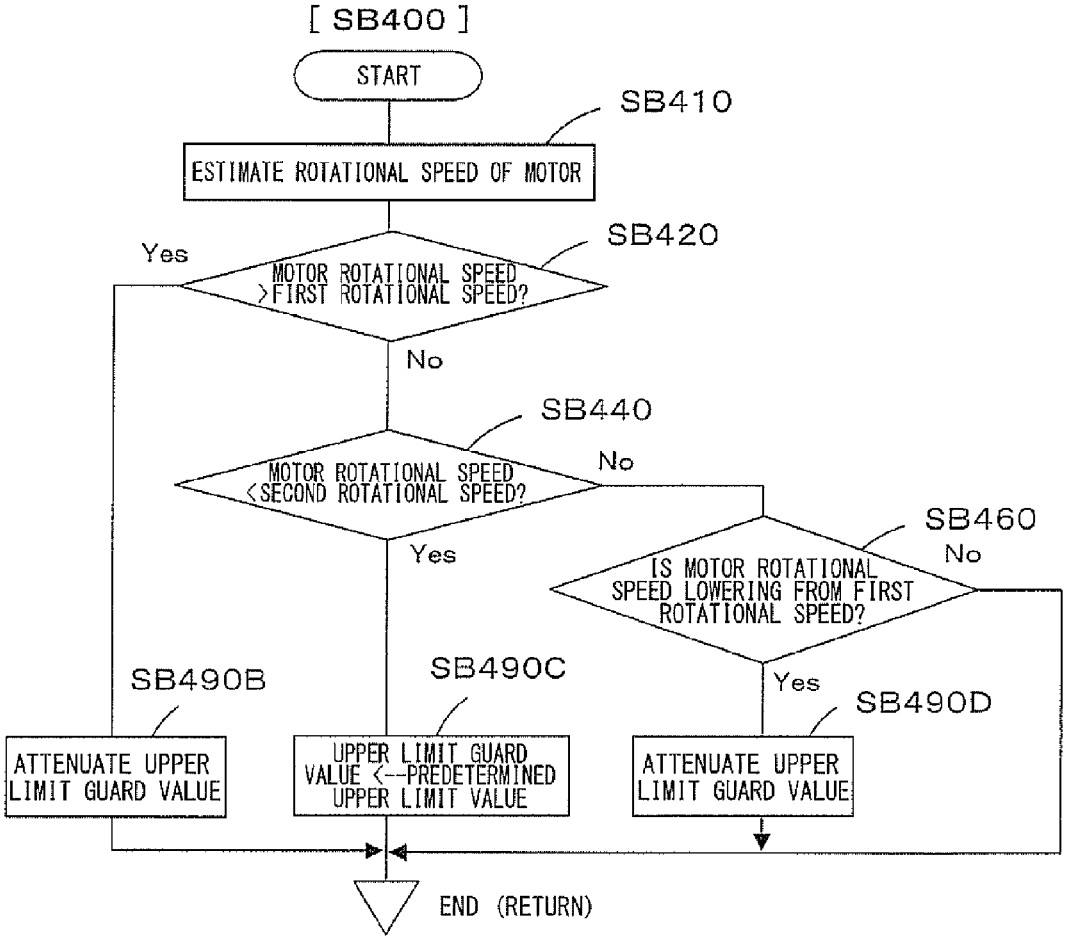
FIG. 18 is a flowchart illustrating a process executed in Step S54 (SB400) in FIG. 17.

FIG. 16 shows a control block diagram of a process performed according to a fourth embodiment. The control block diagram according to the fourth embodiment (FIG. 16) differs from the control block diagram of the comparative example (FIG. 2) in that blocks B70 and B84 are added, and that the upper limit guard value calculated in the block B84 is used in the block B40. In addition, the control block diagram of this embodiment differs from that of the comparative example in that the upper limit guard value is increased or decreased based on the motor rotational speed. Further, the flowchart shown in FIG. 17 differs from the flowchart shown in FIG. 3 in that Step S54 (which corresponds to the blocks B70 and B84 of FIG. 16) is added. FIG. 18 shows the details of the control process performed at SB400 of Step S54. In the following, the process performed at SB400 shown in FIG. 18 will be described. The process shown in FIG. 17 may be started, for example, at predetermined time intervals.

In step SB410 shown in FIG. 18, the low-pressure controller 24 may estimate the rotational speed of the motor 22*m* in the same manner as in step SB110 shown in FIG. 6. The process may then proceed to Step SB420. As described in connection with step SB110, it may be also possible to provide a motor rotational speed detection device, and the rotational speed of the motor 22*m* may be detected based on a detection signal from the motor rotational speed detection device. In the following, the upper limit rotational speed, the first rotational speed, the second rotational speed, the first time TM1, the first period T1, the second period T2, the third period T3, etc. are that same as those described in connection with the first embodiment, and a description thereof will be omitted.

In step SB420, the low-pressure controller may determine whether or not the motor rotational speed is higher than the first rotational speed. If the motor rotational speed is higher than the first rotational speed ("Yes"), the process proceeds to Step SB490B. If the motor rotational speed is not higher than (i.e., less than or equal to) the first rotational speed ("No"), the process proceeds to Step SB440.

In the case that the process has proceeded to Step SB490B (in the case of the point P1 in time at the first time TM1 and during the first period T1), the low-pressure controller 24 may attenuate (subtract) the upper limit guard value by a predetermined amount (see FIG. 19) to complete the process.

In the predetermined value guard period (see FIG. 19) up to the first time TM1, the upper limit guard value may be set to a predetermined upper limit value (e.g., 99%).

In the case that the process has proceeded to Step SB440, the low-pressure controller 24 may determine whether or not the motor rotational speed is less than the second rotational speed. If the motor rotational speed is less than the second rotational speed ("Yes"), the process proceeds to Step SB490C. If the motor rotational speed is not less than (i.e., greater than or equal to) the second rotational speed ("No") (in the case of the second period T2), the process proceeds to Step SB460.

In the case that the process has proceeded to Step SB460 (in the case of the second period T2), the low-pressure controller 24 may determine whether or not the motor rotational speed is lowering (decreasing) from the first rotational speed. If the motor rotational speed is lowering from the first rotational speed ("Yes"), the process proceeds to Step SB490D. If the motor rotational speed is not lowering (i.e., not decreasing) from the first rotational speed ("No"), the process is completed (i.e., the upper limit guard value is maintained without being updated). The determination as to whether or not the motor rotational speed is lowering from the first rotational speed may be made in the same manner as described in connection with the third embodiment, so a description thereof will be omitted.

In the case that the process has proceeded to Step SB490D, the low-pressure controller 24 may attenuate (subtract) the upper limit guard value by a predetermined amount (see FIG. 19) to complete the process. The attenuation amount may be the same as that in Step SB490B, or it may be different from that in Step SB490B.

In the case that the process has proceeded to Step SB490C (in the case of the third period T3), the low-pressure controller 24 may substitute (set) the predetermined upper limit value (e.g., 99%) for the upper limit guard value to complete the process.

Figure 19:
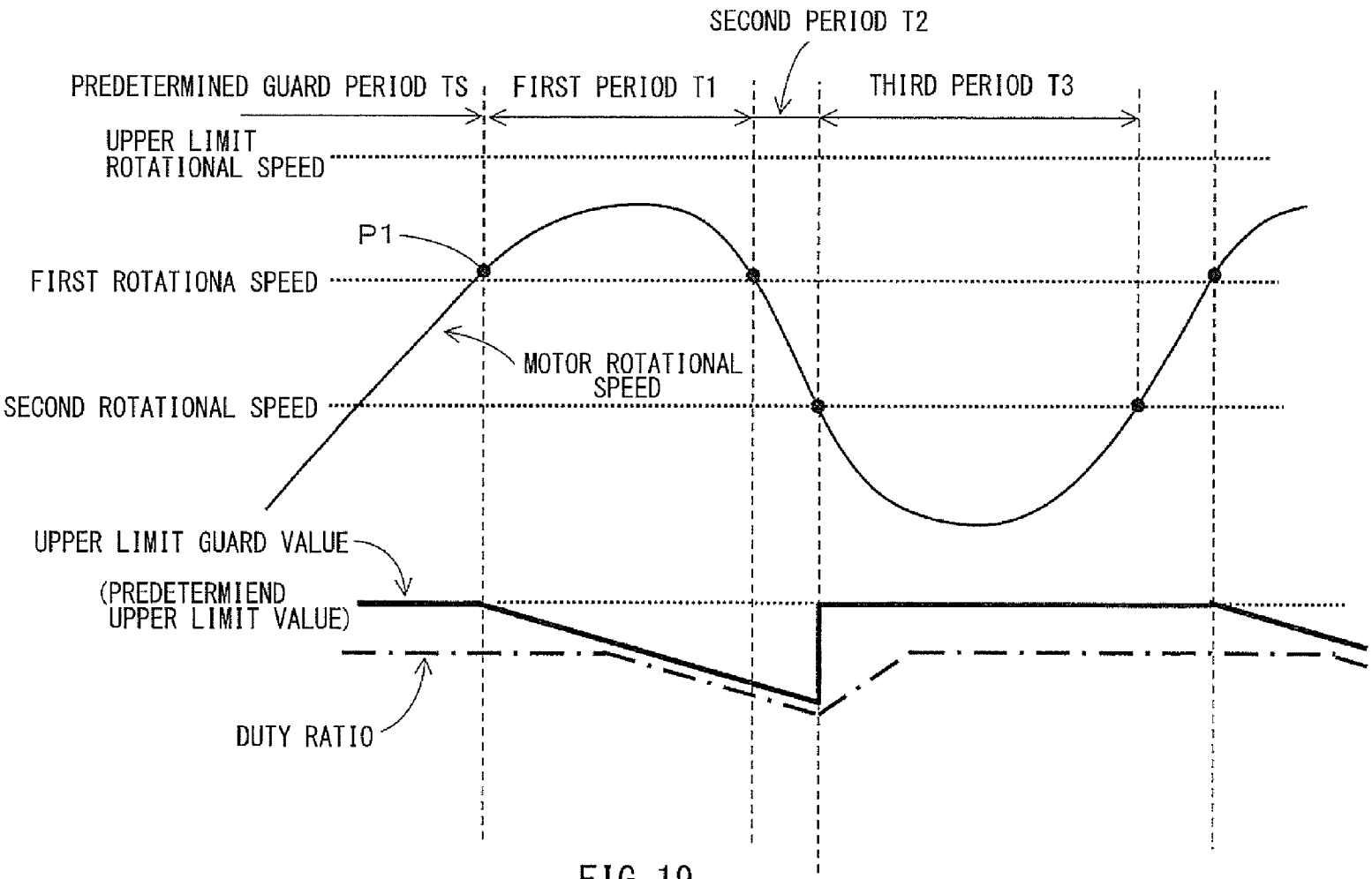
FIG. 19 is a graph illustrating changes with time a motor rotational speed, a duty ratio, and an upper limit guard value in the fuel supply system according to the fourth embodiment.

As shown in FIG. 19, the fourth embodiment differs from the third embodiment (FIG. 15) in that the upper limit guard value is not set to the predetermined lowering value at the first time TM1. At the first time TM1 and during the first period T1 when the motor rotational speed exceeds the first rotational speed, it is possible to reduce the upper limit of the duty ratio so that the motor rotational speed may not reach the upper limit rotational speed. Further, during the third period T3 when the motor rotational speed is less than the second rotational speed, the upper limit guard value may be restored to the predetermined upper limit value, making it possible to restore the reduced upper limit guard value to the predetermined upper limit value at an appropriate timing.

Figure 20:
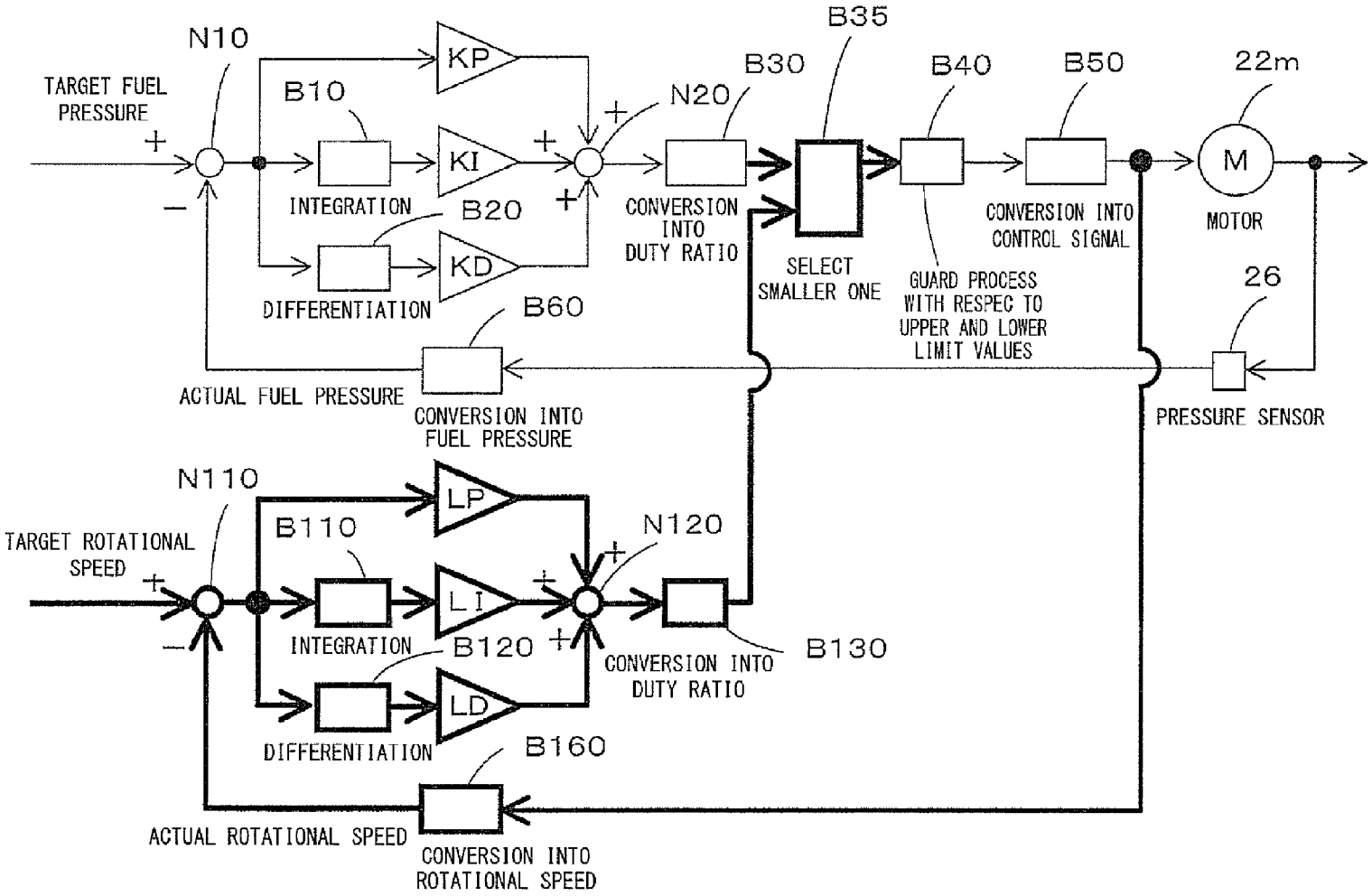
FIG. 20 is a control block diagram illustrating a feedback control for a fuel pressure in a fuel supply system according to a fifth embodiment.
Figure 21:
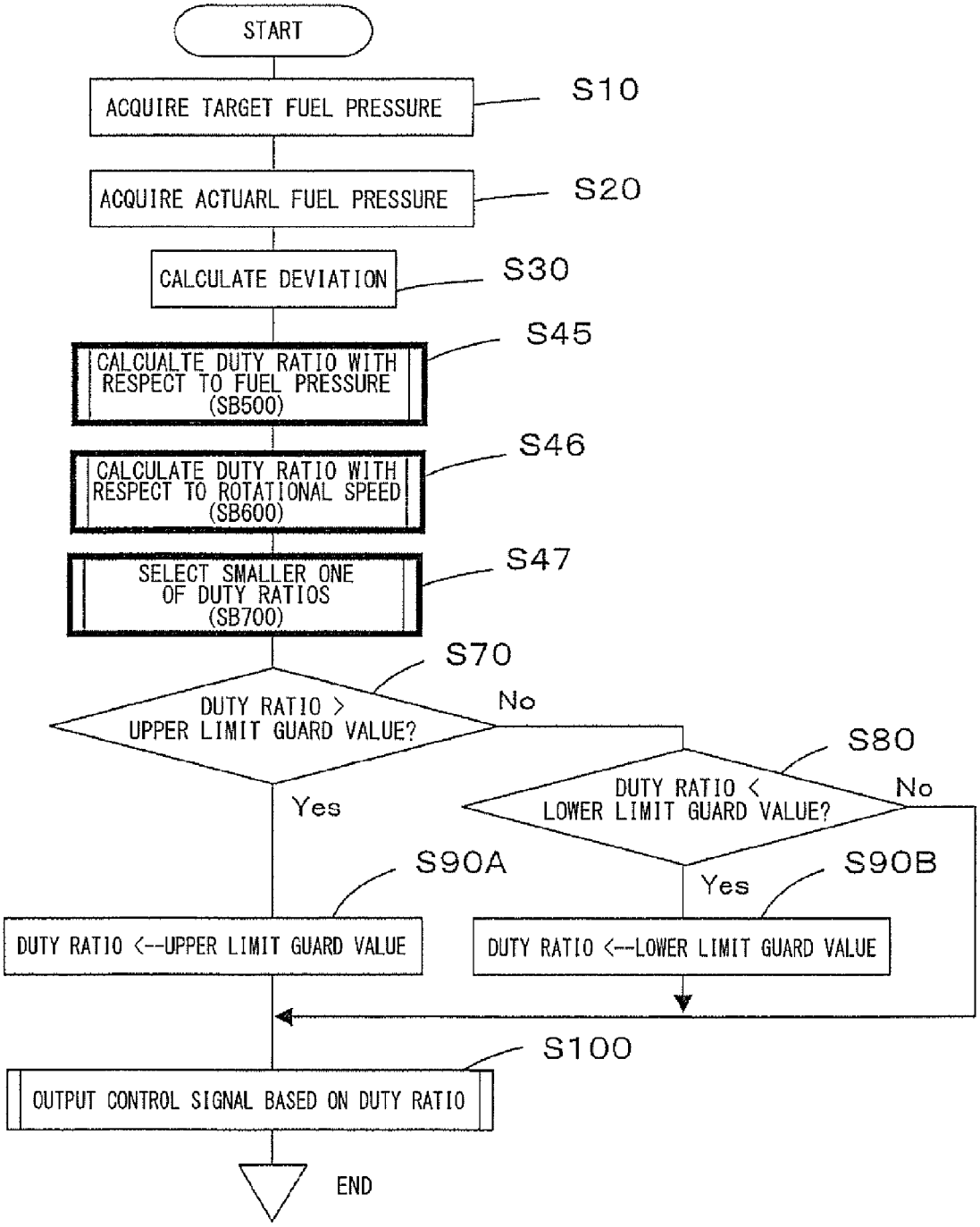
FIG. 21 is a flowchart illustrating a feed back control process for the fuel pressure in the fuel supply system according to the fifth embodiment.

FIG. 20 shows a control block diagram of a process performed according to a fifth embodiment. The control block diagram of the fifth embodiment (FIG. 20) differs from that of the comparative example (FIG. 2) in that blocks B35, B110, B120, B130, and B160, and nodes N110, N120, LP, LI, LD, etc. are added. Further, the control block diagram of the fifth embodiment differs from that of the comparative example in that there is selected, in block B35, the smaller one of the fuel duty ratio calculated at block B30 and the rotational speed duty ratio calculated at the block B130 (when they are the same, one of the two is selected). Further, the flowchart shown in FIG. 21 differs from the flowchart shown in FIG. 3 in that the Step S40 of the flowchart in FIG. 3 is changed to Steps S45 through S47 in FIG. 21. The process in SB500 of Step S45, the process in SB600 of step S46, and the process in SB700 of step S47 are illustrated in detail in FIGS. 22(A), 22(B) and 22(C), respectively. In the following, the processes in SB500, SB600, and SB700 in FIGS. 22(A), 22(B) and 22(C) will be described in detail. The process shown in FIG. 21 may be started, for example, at predetermined time intervals.

Figure 22A:
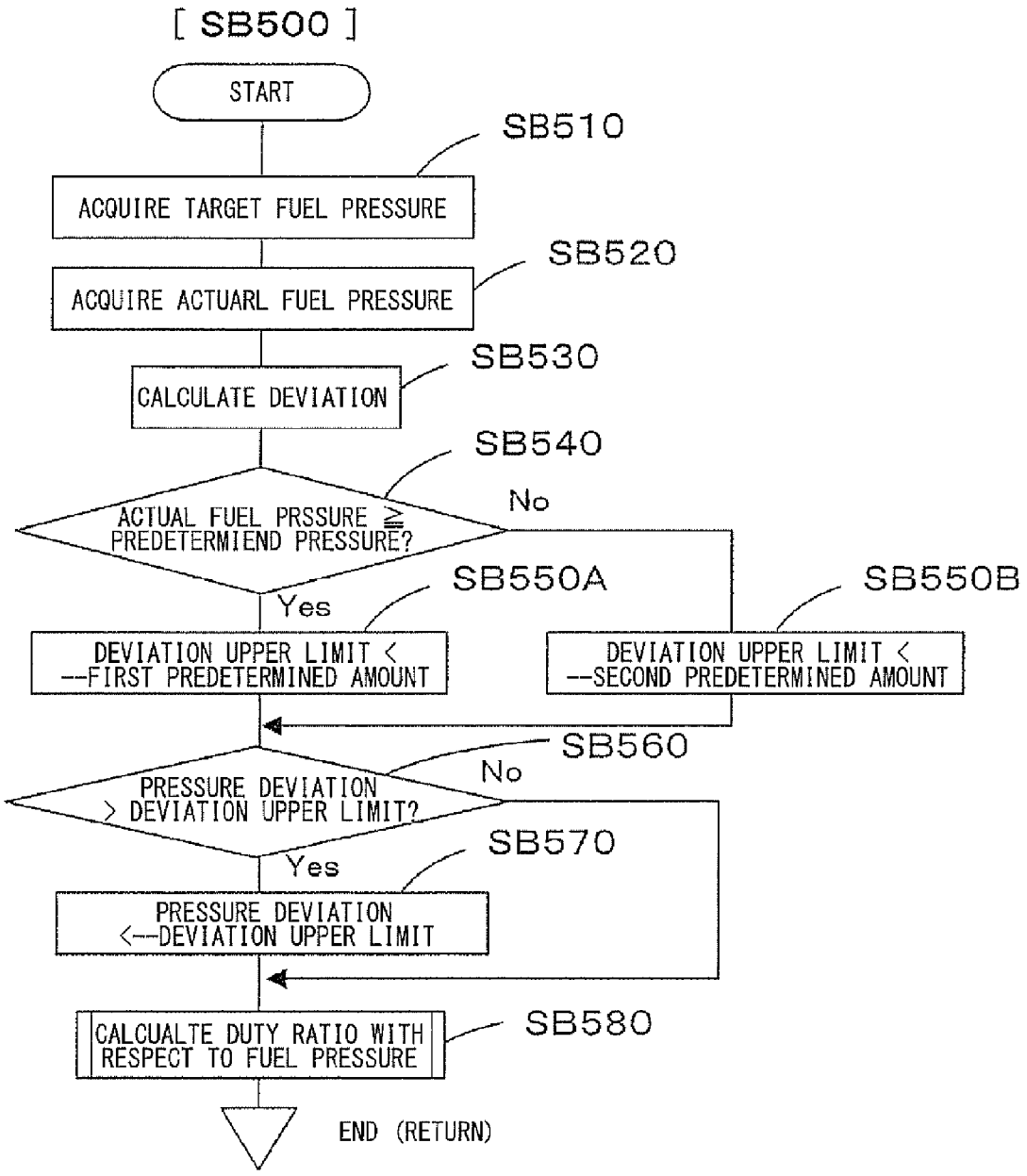
FIGS. 22(A), 22(B) and 22(C) are flowcharts respectively illustrating processes executed in Step S45 (SB500), Step S46 (SB600) and Step S47 (SB700) in FIG. 21.

In step SB510 of SB500 shown in FIG. 22(A), the low-pressure controller 24 may acquire the target fuel pressure from the ECU 40, and the process proceeds to Step SB520. In step SB520, the low-pressure controller 24 may obtain the actual fuel pressure based on the detection signal from the pressure sensor 26, and the process proceeds to Step SB530. In Step SB530, the low-pressure controller 24 may obtain the pressure deviation which is a difference between the target fuel pressure and the actual fuel pressure, and the process proceeds to Step SB540.

In Step SB540, the low-pressure controller 24 may determine whether or not the actual fuel pressure is not less than a predetermined pressure (e.g., 400 kPa). If the actual fuel pressure is not less than (i.e., greater than or equal to) the predetermined pressure ("Yes"), the process proceeds to Step SB550A. If the actual fuel pressure is less than the predetermined pressure ("No"), the process proceeds to Step SB550B.

In the case that the process has proceeded to Step SB550A, the low-pressure controller 24 may substitute (set) a first predetermined amount for the deviation upper limit, and the process then proceeds to step SB560. In the case that the process proceeds to Step SB550B, the low-pressure controller may substitute (set) a second predetermined amount for the deviation upper limit, and the process then proceeds to Step SB560. Each of the first predetermined amount and the second predetermined amount may be an amount that is comparable, for example, with several tens (in kPa), and the first predetermined amount may be smaller than the second predetermined amount.

In Step SB560, the low-pressure controller 24 may determine whether or not the absolute value of the pressure deviation obtained in step SB530 is larger than the deviation upper limit (i.e., whether or not the pressure deviation is out of the range between −[deviation upper limit] and +[deviation upper limit]). If the pressure deviation absolute value is not less than (i.e., greater than or equal to) the deviation upper limit (i.e., out of the range) ("Yes"), the process proceeds to Step SB570. If the pressure deviation absolute value is less than the deviation upper limit (i.e., within the range) ("No2), the process proceeds to step SB580.

In the case that the process has proceeded to Step SB570, the low-pressure controller 24 may guard the pressure deviation such that it is within the range between −(deviation upper limit) and +(deviation upper limit).

In Step SB580, the low-pressure controller 24 may calculate the fuel pressure duty ratio based on the pressure deviation to complete the process. The process for obtaining the fuel pressure duty ratio based on the pressure deviation may be the same as that in the comparative example, so a detailed description thereof will be omitted.

Figure 22B:
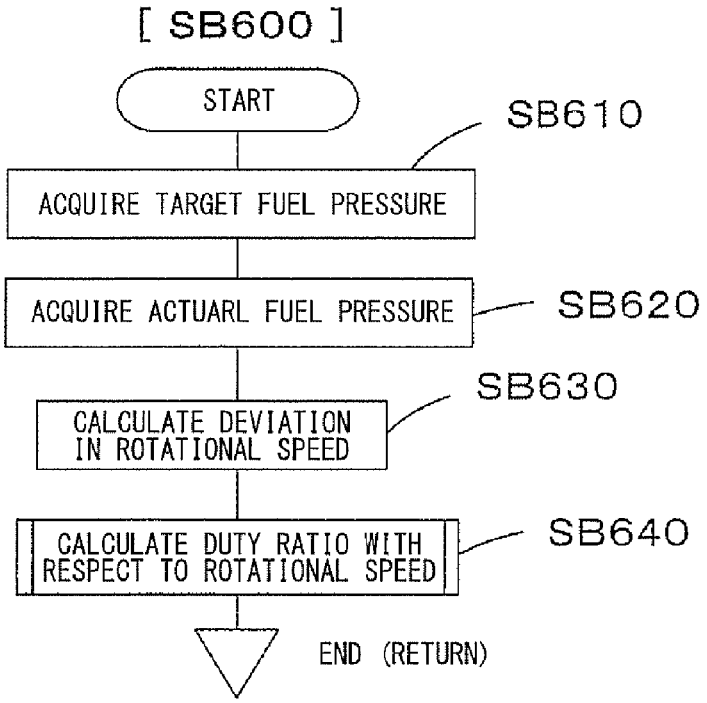

In Step SB610 of SB600 shown in FIG. 22(B), the low-pressure controller 24 may acquire the target rotational speed (i.e., the target rotational speed of the motor 22*m*) from the ECU 40, and the process proceeds to Step SB620. In step SB620, the rotational speed of the motor 22*m* may be estimated in the same manner as in step SB110 shown in FIG. 6, and the process proceeds to Step SB630. As described in connection with Step SB110, it may be also possible to provide a motor rotational speed detection device, and the rotational speed of the motor 22*m* may be detected based on the detection signal from the motor rotational speed detection device. In step SB630, the low-pressure controller 24 may obtain the rotational speed deviation which is a difference between the target rotational speed and the actual rotational speed, and the process proceeds to Step SB640.

In Step SB640, the low-pressure controller 24 may calculate the rotational speed duty ratio based on the rotational speed deviation to complete the process. The process for obtaining the rotational speed duty ratio based on the rotational speed deviation will not be described in detail. However, for example, if the actual rotational speed is close to the upper limit rotational speed, the rotational speed duty ratio may be set to a value slightly smaller than the maximum value.

Figure 22C:
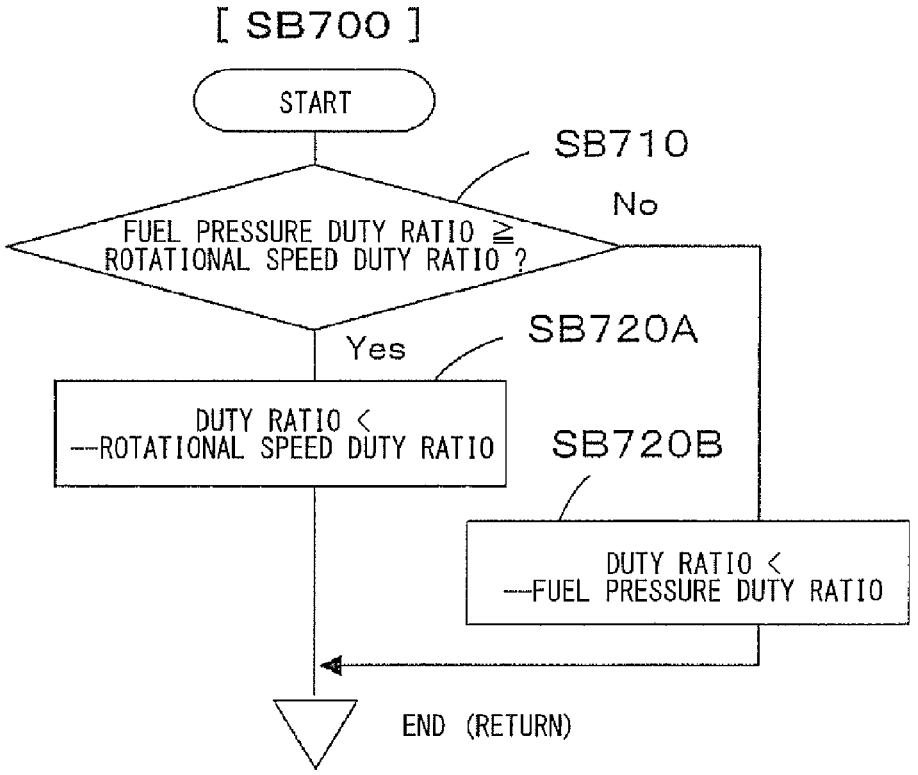

In Step SB710 of SB700 shown in FIG. 22(C), the low-pressure controller 24 may determine whether or not the fuel pressure duty ratio obtained in SB500 is not less than (i.e., greater than or equal to) the rotational speed duty ratio obtained in SB600. If the fuel pressure duty ratio is not less than the rotational speed duty ratio ("Yes"), the process proceeds to Step SB720A. If the fuel pressure duty ratio is less than rotational speed duty ratio ("No"), the process proceeds to Step SB720B.

In the case that the process has proceeded to Step SB720A, the low-pressure controller 24 may substitute (set) the rotational speed duty ratio for the duty ratio to complete the process. In the case that the process has proceeded to Step SB720B, the low-pressure controller 24 may substitute (set) the fuel pressure duty ratio for the duty ratio to complete the process.

In the fifth embodiment described above, the fuel pressure duty ratio and the rotational speed duty ratio (the newly set duty ratio) are obtained, and the duty ratio used for the final output is the smaller one of the fuel pressure duty ratio and the rotational speed duty ratio (one of the two when they are the same). In other words, one of the duty ratios not more than the other duty ratio is selected as the duty ratio used for the final output. In this way, the motor rotational speed does not reach the upper limit rotational speed.

The above embodiments may be modified in various ways. For example, the flowcharts illustrating the processes are not restricted to those described in connection with the above embodiments.

Further, the operational waveforms shown in FIGS. 7, 11, 15, and 19 illustrate examples of the operations in the first through fourth examples. Their operations may not be limited to those of these waveforms.

Although the above embodiments have been described as applied to a vehicle engine as an example of the internal combustion engine, the above teachings can also be applied to any other internal combustion engines.

Further, the ECU 40 may obtain the target fuel pressure (in the first through fifth embodiments) and the target rotational speed (the fifth embodiment) and may output to the low-pressure controller 24. Alternatively, the low-pressure controller 24 may obtain these values.

Further, the expressions such as "not less than (≥)," "not more than (≤)," "more than (>)," and "less than (<)" may or may not include an equal sign. Further, the numerical values disclosed in the description of the above embodiments are only given by way of example, and should not be construed restrictively.

Further, the calculation process for the upper limit guard value at the first time and during the first period according to each of the first through fourth embodiments, may be combined with the calculation process for the upper limit guard value during the second and third periods according to any one of the first through fourth embodiments. For example, the calculation process for the upper limit guard value at the first timing and during the first period described in connection with the third embodiment may be combined with the calculation process for the upper limit guard value during the second and third periods described in connection with the first embodiment.

Representative, non-limiting examples were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved fuel supply systems, and methods of making and using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

What is claimed is:

1. A fuel supply system for an internal combustion engine, comprising:

a fuel pump configured to pump fuel from within a fuel tank and discharge the pumped fuel to the internal combustion engine;

a motor configured to drive the fuel pump; and a controller coupled to the motor and configured to determine a duty ratio of a control signal through a feedback control and to output the control signal to the motor, so that a fuel pressure of the fuel discharged from the fuel pump approaches a target fuel pressure;

wherein the controller is further configured to (i) estimate the duty ratio based on the target fuel pressure and information regarding the fuel pressure of the fuel discharged from the fuel pump, and (ii) guard an upper limit of the duty ratio by an upper limit guard value; and wherein the controller is further configured to change the upper limit guard value based on a rotational speed of the motor.

2. The fuel supply system according to claim 1, wherein the controller is further configured such that:

during a predetermined guard period, the upper limit guard value is set to a predetermined upper limit value of the motor;

wherein the rotational speed of the motor increases from a value lower than a first rotational speed to reach the first rotational speed during the predetermined value, and the first rotational speed is lower than the predetermined upper limit value;

at a first time when the rotational speed of the motor reaches the first rotational speed, the upper limit guard value is set to a current duty ratio that is currently applied;

during a first period after the first time, the upper limit guard value gradually decreases; and wherein the rotational speed of the motor exceeds the first rotational speed during the first period.

3. The fuel supply system according to claim 2, wherein the controller is further configured such that:

during a second period after the first period, the upper limit guard value is maintained without being updated;

wherein the rotational speed of the motor is less than the first rotational speed and is not less than a second rotational speed during the second period, and the second rotational speed is not less than the first rotational speed;

if the target fuel pressure is not less than an actual fuel pressure during a third period after the second period, the upper limit guard value is maintained without being updated;

if the target fuel pressure is less than the actual fuel pressure during the third period, the upper limit guard value is set to the predetermined upper limit value; and wherein the rotational speed of the motor is less than the second rotational speed during the third period.

4. The fuel supply system according to claim 1, wherein the controller is further configured such that:

during a predetermined guard period, the upper limit guard value is set to a predetermined upper limit value of the motor;

wherein the rotational speed of the motor increases from a value lower than a first rotational speed to reach the first rotational speed during the predetermined value, and the first rotational speed is lower than the predetermined upper limit value;

at a first time when the rotational speed of the motor reaches the first rotational speed, the upper limit guard value is set to a current duty ratio that is currently applied;

during a first period after the first time, the upper limit guard is maintained without being updated; and wherein the rotational speed of the motor exceeds the first rotational speed during the first period.

5. The fuel supply system according to claim 4, wherein the controller is further configured such that:

during a second period after the first period, the upper limit guard value is maintained without being updated;

wherein the rotational speed of the motor is less than the first rotational speed and is not less than a second rotational speed during the second period, and the second rotational speed is not less than the first rotational speed;

during a third period after the second period, the upper limit guard value is set to the predetermined upper limit value; and wherein the rotational speed of the motor is less than the second rotational speed during the third period.

6. The fuel supply system according to claim 1, wherein the controller is further configured such that:

during a predetermined guard period, the upper limit guard value is set to a predetermined upper limit value of the motor;

wherein the rotational speed of the motor increases from a value lower than a first rotational speed to reach the first rotational speed during the predetermined value, and the first rotational speed is lower than the predetermined upper limit value;

at a first time when the rotational speed of the motor reaches the first rotational speed, the upper limit guard value is set to a predetermined lowering value lower than the predetermined upper limit value;

during a first period after the first time, the upper limit guard value gradually decreases; and wherein the rotational speed of the motor exceeds the first rotational speed during the first period.

7. The fuel supply system according to claim 6, wherein the controller is further configured such that:

if the rotational speed of the motor is lowering during a second period after the first period, the upper limit guard value gradually decreases;

if the rotational speed of the motor is not lowering during the second period, the upper limit guard value is maintained without being updated;

wherein the rotational speed of the motor is less than the first rotational speed and is not less than a second rotational speed during the second period, and the second rotational speed is not less than the first rotational speed;

during a third period after the second period, the upper limit guard value is set to the predetermined upper limit value; and wherein the rotational speed of the motor is less than the second rotational speed during the third period.

8. The fuel supply system according to claim 1, wherein the controller is further configured such that:

during a predetermined guard period, the upper limit guard value is set to a predetermined upper limit value of the motor;

wherein the rotational speed of the motor increases from a value lower than a first rotational speed to reach the first rotational speed during the predetermined value, and the first rotational speed is lower than the predetermined upper limit value;

at a first time when the rotational speed of the motor reaches the first rotational speed and during a first period after the first time, the upper limit guard value gradually decreases; and wherein the rotational speed of the motor exceeds the first rotational speed during the first period.

9. The fuel supply system according to claim 8, wherein the controller is further configured such that:

if the rotational speed of the motor is lowering during a second period after the first period, the upper limit guard value gradually decreases;

if the rotational speed of the motor is not lowering during the second period, the upper limit guard value is maintained without being updated;

wherein the rotational speed of the motor is less than the first rotational speed and is not less than a second rotational speed during the second period, and the second rotational speed is not less than the first rotational speed;

during a third period after the second period, the upper limit guard value is set to the predetermined upper limit value; and wherein the rotational speed of the motor is less than the second rotational speed during the third period.

10. The fuel supply system according to claim 1, wherein:

the controller is further configured to calculate a fuel pressure duty ratio and a rotational speed duty ratio and to select a smaller one of the fuel pressure duty ratio and the rotational speed duty ratio as the duty ratio of the control signal;

the fuel pressure duty ratio is determined based on a difference between the target fuel pressure and an actual fuel pressure; and the rotational speed duty ratio is determined based on a difference between a target rotational speed of the motor and an actual speed of the motor.

11. The fuel supply system according to claim 1, wherein:

the controller is further configured to estimate the rotational speed of the motor based on the control signal that is outputted to the motor.

* * * * *